US009019050B2

(12) United States Patent
Larcher et al.

(10) Patent No.: US 9,019,050 B2
(45) Date of Patent: Apr. 28, 2015

(54) ELECTRIC SWITCHING SYSTEM COMPRISING AN ELECTRIC SWITCHING MODULE INCLUDING TWO ELEMENTS COUPLING A CONTACT(S)-HOLDER WITH ITS DRIVING DEVICE

(71) Applicant: Schneider Electric Industries SAS, Rueil-Malmaison (FR)

(72) Inventors: Patrick Larcher, Echirolles (FR); Michel Lauraire, Saint Maur des Fosses (FR); Patrick Comtois, Saint-Ismier (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/692,773

(22) Filed: Dec. 3, 2012

(65) Prior Publication Data

US 2013/0140153 A1 Jun. 6, 2013

(30) Foreign Application Priority Data

Dec. 6, 2011 (FR) ..... 11 61210
Dec. 6, 2011 (FR) ..... 11 61211
Dec. 6, 2011 (FR) ..... 11 61214

(51) Int. Cl.
*H01H 67/02* (2006.01)
*H01H 9/26* (2006.01)
(Continued)

(52) U.S. Cl.
CPC ..... *H01H 9/26* (2013.01); *H01H 11/0006* (2013.01); *H01H 50/002* (2013.01);
(Continued)

(58) Field of Classification Search
USPC ..... 335/106, 127, 129–135, 156, 202
See application file for complete search history.

(56) References Cited

U.S. PATENT DOCUMENTS 3,835,425 A 9/1974 Karch et al.
5,347,250 A * 9/1994 Muske ..... 335/132
(Continued)

FOREIGN PATENT DOCUMENTS

DE 1 209 637 4/1964
DE 32 30 561 A1 2/1984
(Continued)

OTHER PUBLICATIONS

French Preliminary Search Report and Written Opinion issued Jul. 17, 2012 in corresponding French Application No. 11 61211 filed on Dec. 6, 2011 (with an English Translation of Categories).
(Continued)

*Primary Examiner* — Bernard Rojas
(74) *Attorney, Agent, or Firm* — Oblon, McClelland, Maier & Neustadt, L.L.P.

(57) ABSTRACT

An electric switching system comprises first, second, and third input terminals, first, second, and third output terminals, an electric switching module, and a control module. The electric switching module includes two first switches and two second switches, each switch having a fixed input contact, a fixed output contact, and a mobile contact. Fixed input contacts are connected to fixed output contacts via mobile contacts in a closed position and insulated from each other in an open position. A holder member is configured to be moved by an electric driving device between a first position and a second position. The holder member includes a first mechanical coupling element and a second mechanical coupling element. The control module includes the driving device. The holder member is mechanically coupled to the driving device via the first coupling element in a primary configuration or via the second coupling element in a secondary configuration.

16 Claims, 12 Drawing Sheets

(51) Int. Cl.

| | |
|---|---|
| ***H01H 11/00*** | (2006.01) |
| ***H01H 50/00*** | (2006.01) |
| ***H01H 51/00*** | (2006.01) |
| *H01H 50/04* | (2006.01) |
| *H01H 50/54* | (2006.01) |
| *H01H 50/64* | (2006.01) |

(52) U.S. Cl.
CPC ..... *H01H 50/042* (2013.01); *H01H 50/546* (2013.01); *H01H 50/643* (2013.01); *H01H 51/005* (2013.01); *H01H 2011/0025* (2013.01)

(56) References Cited

U.S. PATENT DOCUMENTS

| | | | | |
|---|---|---|---|---|
| 5,382,934 | A | 1/1995 | Hendel et al. | |
| 6,411,184 | B1 | 6/2002 | Comtois et al. | |
| 6,483,049 | B1 * | 11/2002 | Mohtasham | 200/5 R |
| 6,661,320 | B1 | 12/2003 | Fausch | |
| 7,332,989 | B2 * | 2/2008 | Jones | 335/132 |
| 7,821,364 | B2 * | 10/2010 | Birzer et al. | 335/132 |
| 8,093,973 | B2 * | 1/2012 | Takaya et al. | 335/133 |
| 2002/0175788 | A1 | 11/2002 | Comtois et al. | |

FOREIGN PATENT DOCUMENTS

| | | | |
|---|---|---|---|
| DE | 32 30 562 | C2 | 2/1984 |
| EP | 1 120 806 | A1 | 8/2001 |
| FR | 2 296 282 | | 7/1976 |
| WO | WO 93/01609 | | 1/1993 |
| WO | WO 00/33341 | | 6/2000 |
| WO | WO 2007/036179 | A1 | 4/2007 |

OTHER PUBLICATIONS

French Preliminary Search Report and Written Opinion issued Jul. 17, 2012 in corresponding French Application No. 11 61210 filed on Dec. 6, 2011 (with an English Translation of Categories).

French Preliminary Search Report and Written Opinion issued Aug. 27, 2012 in corresponding French Application No. 11 61214 filed on Dec. 6, 2011 (with an English Translation of Categories).

* cited by examiner

ELECTRIC SWITCHING SYSTEM COMPRISING AN ELECTRIC SWITCHING MODULE INCLUDING TWO ELEMENTS COUPLING A CONTACT(S)-HOLDER WITH ITS DRIVING DEVICE

FIELD OF THE INVENTION

The present invention concerns an electric switching system comprising a first, a second and a third input terminal, a first, a second and a third output terminal, an electric switching module and a control module for controlling the switching module.

The electric switching module comprises two first switches and two second switches, each electric switch being capable of switching between an open position and a closed position and comprising a fixed input contact, a fixed output contact and a mobile contact, the contacts being electrically conductive, the two fixed contacts able to be electrically connected via the mobile contact in closed position of the electric switch and electrically insulated from each other in open position of the electric switch, and a holder member of the mobile contacts, the holder member being able to be moved by an electric driving device between a first position corresponding to a position among the open and closed positions of the switch and a second position corresponding to the other of the positions among the open and closed positions of the switch so as to ensure simultaneous switching of the electric switches, the holder member comprising a first mechanical coupling element with the electric driving device in a primary configuration of the driving device relative to the switching module.

The first and second input terminals are each electrically connected to a fixed input contact of a respective first electric switch and to a fixed input contact of a respective second electric switch, and the first and second output terminals each being electrically connected to a fixed output contact of a respective first electric switch and to a fixed output contact of a respective second electric switch, so as to connect the first input terminal to the first output terminal and the second input terminal to the second output terminal in closed position of the first switches, and to connect the first input terminal to the second output terminal and the second input terminal to the first output terminal in closed position of the second switches, the third output terminal being electrically connected to the third input terminal.

BACKGROUND OF THE INVENTION

An electric switching system is known from document WO/0033341 A1 comprising three input terminals, three output terminals, an electric switching module having three first and three second electric switches, and a module controlling the electric switching module. Said switching system is intended to be fixed onto a rail conforming to standard DIN 46277 (of the Deutsches Institut für Normung) also called a DIN rail.

Each input terminal is connected to a fixed input contact of a first respective switch and to a fixed input contact of a second respective switch, and each output terminal is connected to a fixed output contact of a first switch and to a fixed output contact of a second switch, so as to connect the first input terminal to the first output terminal, the second input terminal to the second output terminal and the third input terminal to the third output terminal in closed position of the first switches, and to connect the first input terminal to the second output terminal, the second input terminal to the first output terminal and the third input terminal to the third output terminal in closed position of the second switches;

In closed position of each switch, the two fixed contacts of the switch are electrically connected together via a mobile contact, also called a contact bridge. The switching module comprises a holding member of the mobile contacts, also called a contacts-holder, on which the mobile contacts are arranged of the first and second electric switches.

The control module comprises the electric driving device able to move the contacts-holder between a first position in which the first switches are closed and the second switches are open, and a second position in which the first switches are open and the second switches are closed.

However, said electric switching system is not upgradeable and only allows the connecting of the input and output terminals to external electric cables via respective screw/nut assemblies.

It is therefore the objective of the invention to propose an electric switching system allowing several possible configurations of the switching module relative to its control module, whilst minimising necessary handling operations to change over from one configuration to another.

SUMMARY OF THE INVENTION

To this end, the subject-matter of the invention is an electric switching system of the aforementioned type, in which the holder member comprises a second mechanical coupling element with the electric driving device in a secondary configuration of the driving device relative to the switching module, wherein the control module comprises the electric driving device, and wherein the holder member is mechanically coupled to the driving device via the first coupling element in a primary configuration of the control module relative to the switching module, or else via the second coupling element in the secondary configuration of the control module relative to the switching module.

According to other advantageous aspects of the invention, the switching system comprises one or more of the following characteristics, taken alone or in any technically possible combination:

- the holder member is able to be moved in translation in a drive direction by the driving device;
- the first mechanical coupling element and the second mechanical coupling element are transverse mechanical coupling elements symmetrical with each other relative to a plane containing the drive direction;
- the first mechanical coupling element and the second mechanical coupling element are axial mechanical coupling elements symmetrical with each other relative to a plane perpendicular to the drive direction;
- the holder member comprises a transverse mechanical coupling element with the driving device capable of allowing the coupling of the driving device with the holder member in a direction perpendicular to the drive direction, and an axial mechanical coupling element with the driving device capable of allowing the coupling of the driving device with the holder member in a direction parallel to the drive direction;
- the holder member comprises a first and a second transverse coupling element symmetrical with each other relative to a plane containing the drive direction, and a first and a second axial coupling element symmetrical with each other relative to a plane perpendicular to the drive direction;
- the axial mechanical coupling element comprises a rod extending in the drive direction and a coupling head arranged at one end of the rod, the coupling head being able to be mechanically connected via a connecting element to another head secured to the driving device;

at least one module, among the switching module and the control module, comprises a protective cover and the connecting element is part of the protective cover, mobile between a first separation position in which the two coupling elements are mechanically separated from each other and a second associated position in which the two coupling elements are mechanically connected via the connecting element;

the system comprises locking means to lock the connecting element in its second position;

the system comprises guiding means to guide the connecting element between its first and second positions;

the protective cover comprises means for attaching the connecting element in its first position, the said attaching means preferably being breakable;

the axial mechanical coupling element comprises an orifice to receive a rod secured to the driving device and a pin to hold the rod in the receiving orifice, the receiving orifice extending in the drive direction;

the transverse mechanical coupling element comprises two fingers extending transversally and capable of cooperating with one end of a driving lever mechanically connected to the driving device;

each terminal comprises a mounting plate for the connection of an electric cable by means of a screw/nut assembly and a connector pin for connection to a printed circuit, the pin being intended to be soldered to the printed circuit, the connector pin preferably being made in one piece with the mounting plate; and the system comprises three first switches and three second switches, each input terminal being electrically connected to a fixed input contact of a respective first electric switch and to a fixed input contact of a respective second electric switch, and each output terminal being electrically connected to a fixed output contact of a respective first electric switch and to a fixed output contact of a respective second electric switch, so as to connect the first input terminal to the first output terminal, the second input terminal to the second output terminal and the third input terminal to the third output terminal in closed position of the first switches, and to connect the first input terminal to the second output terminal, the second input terminal to the first output terminal and the third input terminal to the third output terminal in closed position of the second switches.

BRIEF DESCRIPTION OF THE DRAWINGS

These characteristics and advantages of the invention will become apparent on reading the following description given solely as an example and with reference to the appended drawings in which.

DETAILED DESCRIPTION OF PREFERRED EMBODIMENTS

Figure 1:
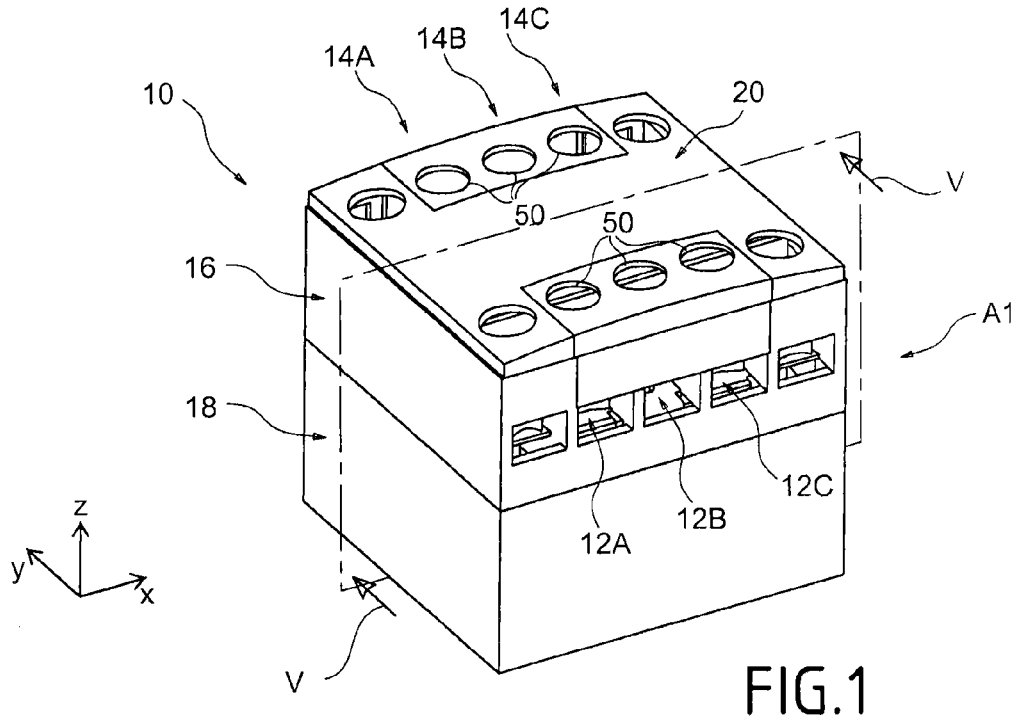
FIGS. 1 to 4 are schematic, perspective illustrations of an electric switching system according to the invention, comprising a switching module and a control module, FIGS. 1, 2, 3 and 4 illustrating the system in a first, second, third and respectively fourth configuration of the control module relative to the switching module.

According to FIG. 1, an electric switching system 10 comprises a first 12A, a second 12B and a third 12C input terminal and a first 14A, a second 14B and a third 14C output terminal.

The electric switching system 10 comprises an electric switching module 16, a control module 18 controlling the electric switching module and a protective cover 20. The electric switching system 10 is a modular system and has different configurations of the control module 18 relative to the switching module 16 such as illustrated in FIGS. 1 to 4.

Figure 2:
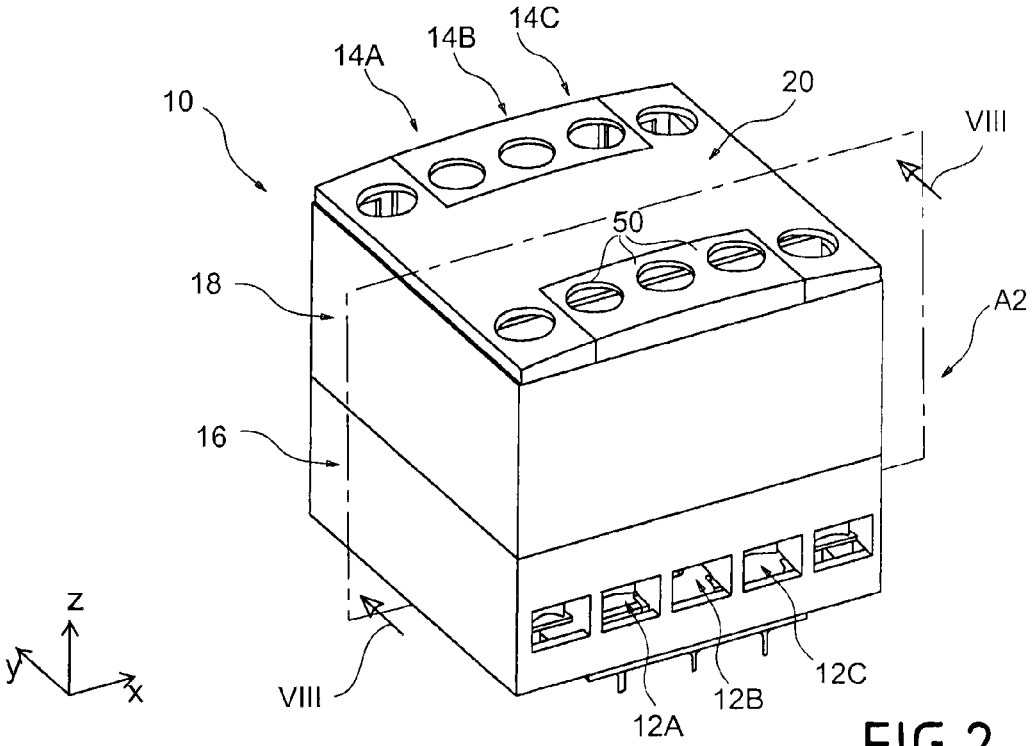

According to a first A1 and a second A2 configuration, also called transverse configurations, respectively shown in FIGS. 1 and 2, the switching module 16 and the control module 18 are stacked along a vertical axis Z extending from bottom upwards. According to the first configuration A1, also called the primary transverse configuration, the switching module 16 is arranged above the control module 18 (FIG. 1), in a conventional configuration for rail mounting. According to the second configuration A2, also called the secondary transverse configuration, the switching module 16 is arranged underneath the control module 18 (FIG. 2) in a conventional configuration for mounting on a printed circuit board.

Figure 3:
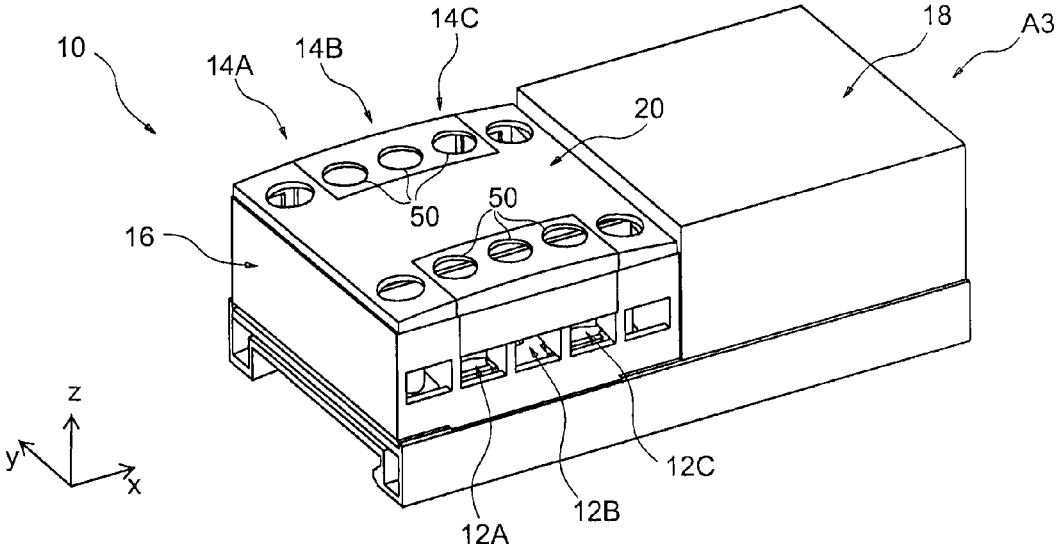
Figure 4:
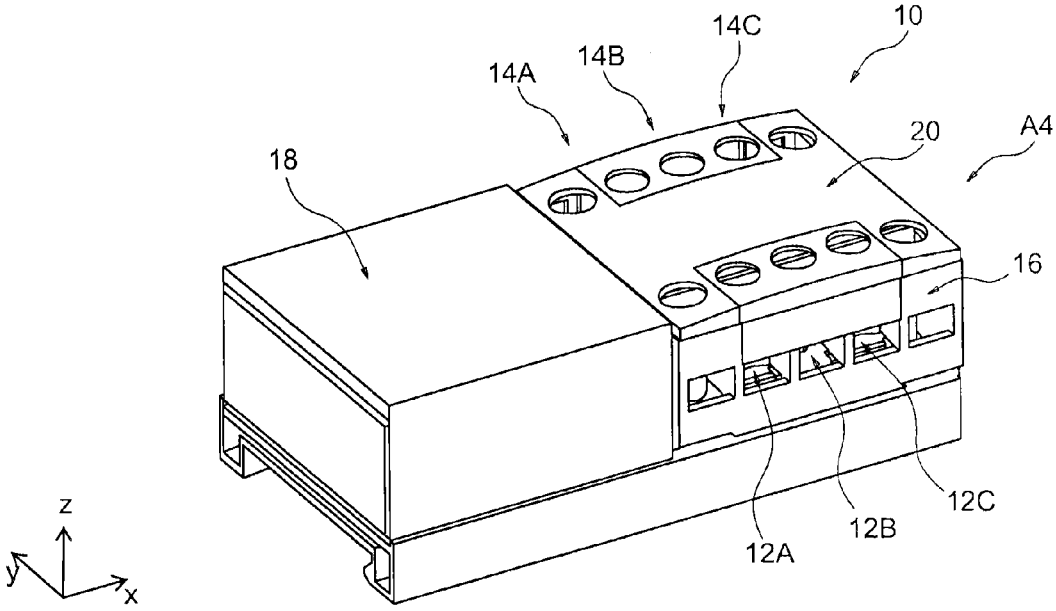

According to a third A3 and a fourth A4 configuration, also called axial configurations which can be seen in FIGS. 3 and 4 respectively, the switching module 16 and the control module 18 are arranged side by side along a longitudinal axis X extending from back to front. According to the third configuration A3, also called the primary axial configuration, the switching module 16 is behind the control module 18 (FIG. 3). According to the fourth configuration A4, also the secondary axial configuration, the switching module 16 is in front of the control module 18 (FIG. 4).

Figure 7:
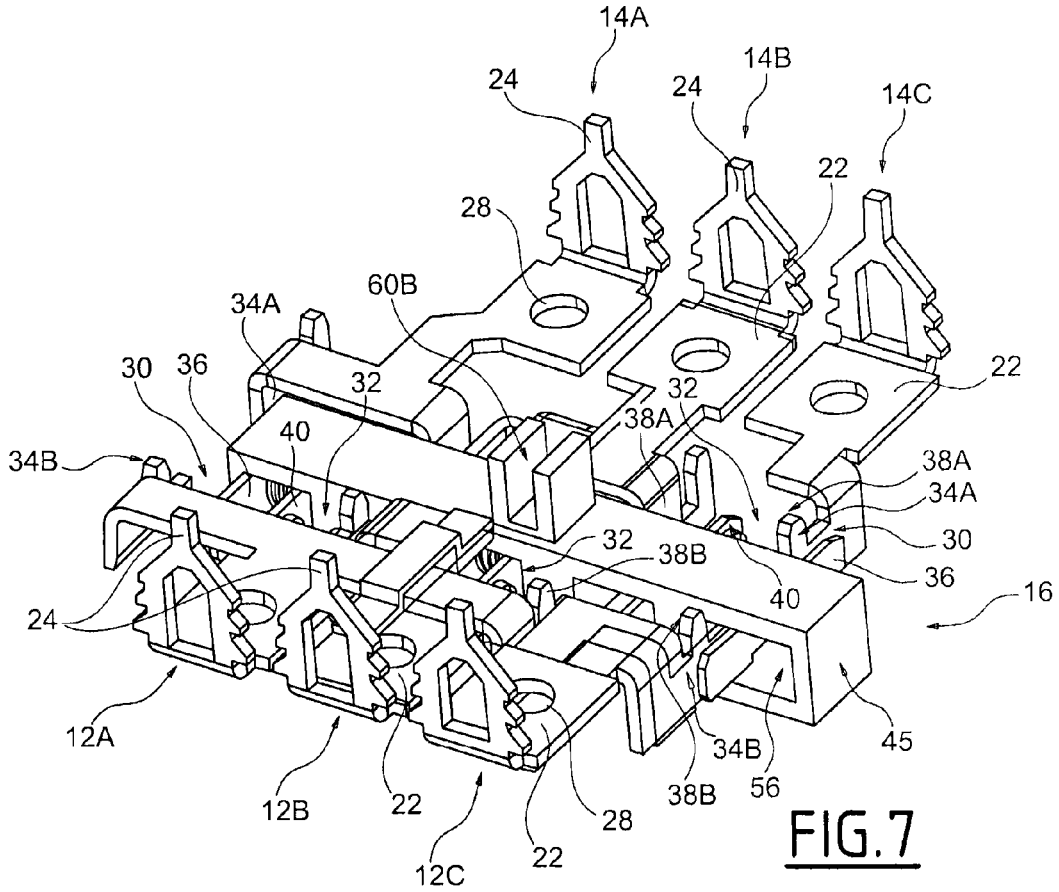
FIG. 7 is a perspective view of input and output terminals and partly of the contacts-holder of the switching system in FIG. 1, in which axial coupling elements of the contacts-holder with the driving device are not shown.

The switching system 10 is able to be fixed onto a rail conforming to standard DIN 46277, also called a DIN rail, according to a first configuration of the input and output terminals shown in FIGS. 1 and 7. In addition, the switching system 10 is able to be connected to a printed circuit board—PCB in a second configuration of the input and output terminals shown in FIGS. 2 and 9.

The switching system 10 is capable of allowing the passing of an electric current of strong intensity, in particular stronger than 10 A. The switching system 10 is a three-phase reversing switch for example, able to be connected between an electric motor and a motor power supply system, not shown, to allow the swapping of two phases of a three-phase current powering the electric motor, to reverse the direction of rotation of the electric motor.

Figure 5:
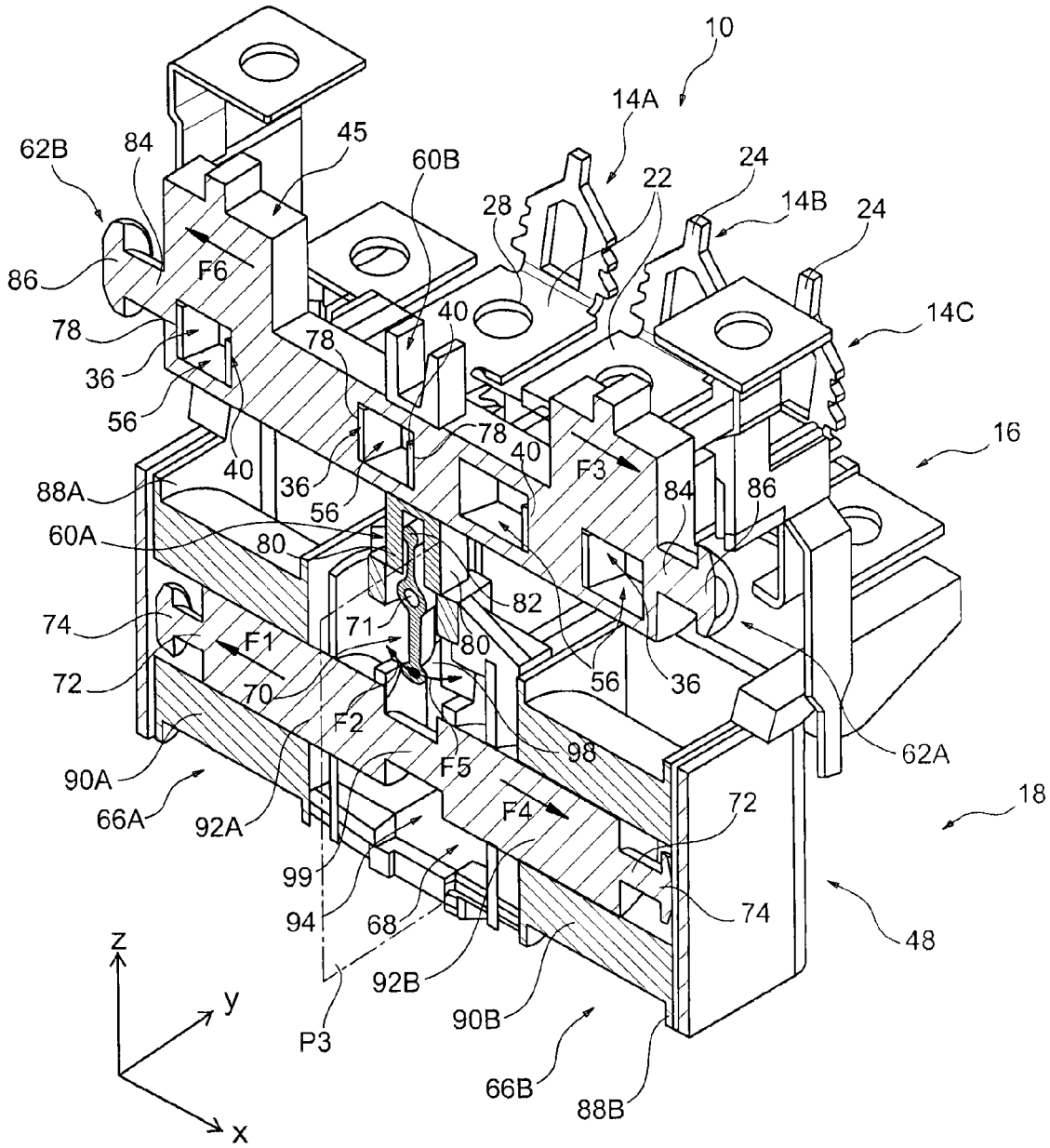
FIG. 5 is a partial cross-sectional view along plane V in FIG. 1.
Figure 8:
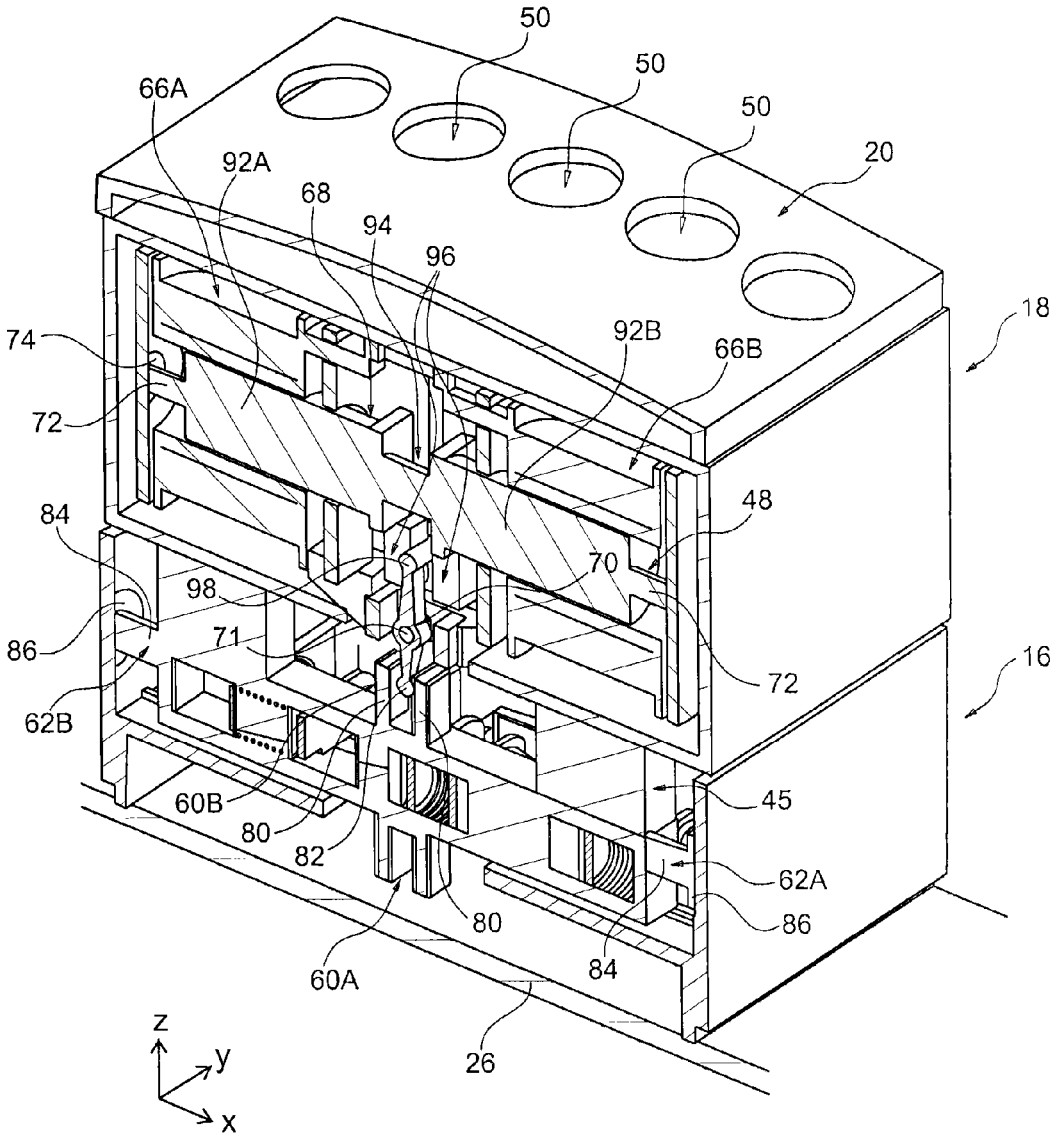
FIG. 8 is a partial cross-sectional view along plane VIII in FIG. 2.
Figure 9:
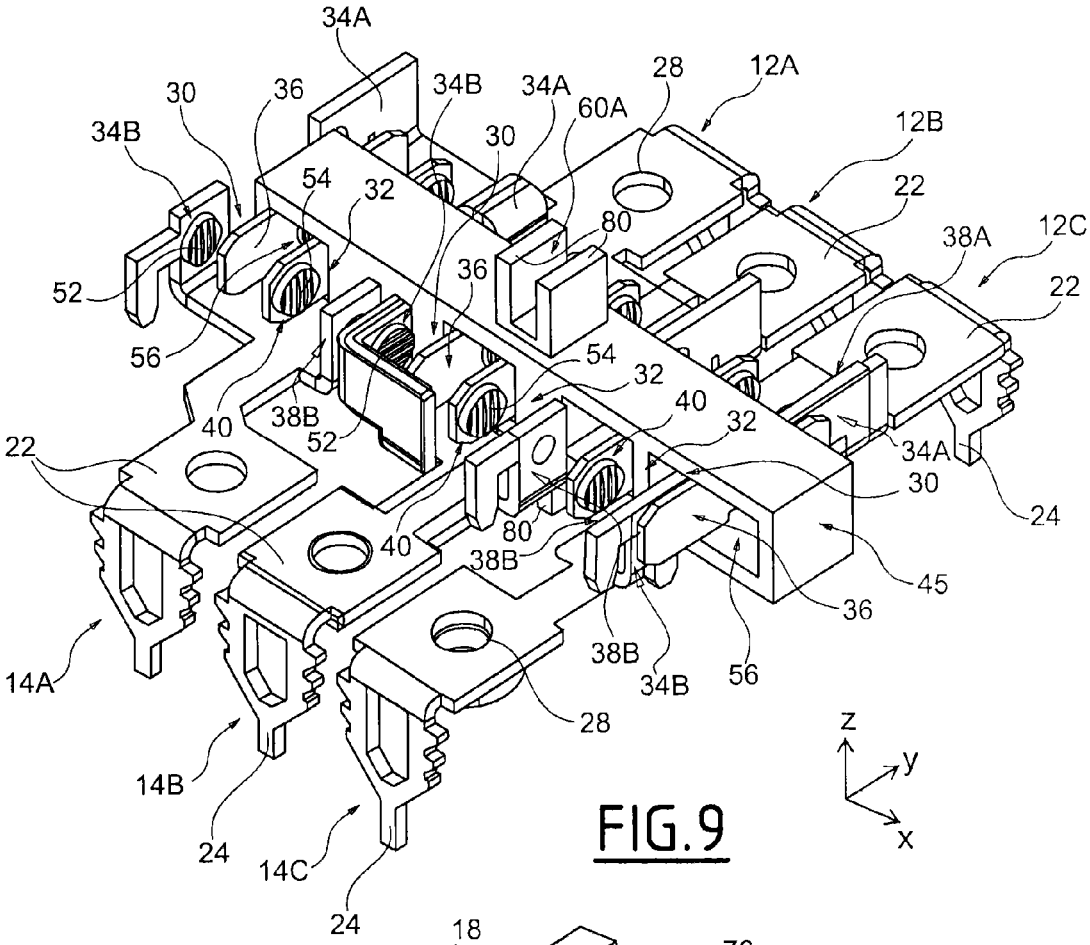
FIG. 9 is a similar view to FIG. 7 in the second configuration of the control module relative to the switching module.

The input terminals 12A, 12B, 12C and the output terminals 14A, 14B, 14C which can be seen in FIGS. 5, 7 and 9, each comprise a mounting plate 22 for the connection of an electric cable, not shown, by means of a screw/nut assembly 23 (FIG. 12), and a connector pin 24 to a printed circuit, the pin 24 being intended to be soldered to the printed circuit 26 as can be seen in FIG. 8. The mounting plate 22 comprises an orifice 28 for passing the shank of the screw of a screw/nut assembly. The connector pin 24 is made in one piece with the mounting plate 22.

The switching module 16 comprises three first electric switches 30 and three second electric switches 32, each electric switch 30, 32 being able to be switched between an open position and a closed position.

Each first switch 30, which can be seen in FIGS. 5 and 7, comprises a first fixed input contact 34A, a first fixed output contact 34B, and a first mobile contact 36, the contacts 34A, 34B, 36 being electrically conductive. The first fixed contacts 34A, 34B are able to be electrically connected via the first mobile contact 36 in closed position of the corresponding first electric switch 30, and electrically insulated from each other in open position of the first switch 30.

Each second electric switch 32 comprises a second fixed input contact 38A, a second fixed output contact 38B and a second mobile contact 40, the contacts 38A, 38B, 40 being electrically conductive. The second fixed contacts 38A, 38B are able to be electrically connected via the second mobile contact 40 in closed position of the corresponding second electric switch 32 and electrically insulated from each other in open position of the second switch 32.

In the example of embodiment shown in FIGS. 7 and 9, each input terminal 12A, 12B, 12C is electrically connected to a respective first fixed input contact 34A and to a second fixed input contact 38A, and each output terminal 14A, 14B, 14C is electrically connected to a respective first fixed output contact 34B and to a second fixed output contact 38B, so that the first 12A, second 12B and third 12C input terminals are respectively connected to the first 14A, second 14B and third 14C output terminals in closed position of the first switches 30, and so that the first input terminal 12A is connected to the second output terminal 14B, the second input terminal 12B is connected to the first output terminal 14A, and the third input terminal 12C is connected to the third output terminal 14C in closed position of the second switches 32.

The switching module 16 comprises a holder member 45 to hold the plurality of mobile contacts 36, 40, also called a contacts-holder, mobile between a first position in which the first switches 30 are closed and the second switches 32 are open, and a second position in which the first switches 30 are open and the second switches 32 are closed.

In the example of embodiment shown in FIGS. 5 to 10, the switching module 16 comprises six electric switches 30, 32 namely three first electric switches 30 able to be in closed position when the holder member 45 is in its first position, and three second electric switches 32 able to be in closed position when the holder member 45 is in its second position. The switching module 16 comprises three first mobile contacts 36 and three second mobile contacts 40.

The control module 18 comprises a driving device 48 to drive the holder member 45 between its first and second positions, so as to ensure simultaneous switching of the plurality of electric switches 30, 32.

The protective cover 20 which can be seen in FIGS. 1 to 4 comprises openings 50 providing access to the input terminals 12A, 12B, 12C and to the output terminals 14A, 14B, 14C, the said access openings 50 allowing a user to secure the clamp of an electric cable onto a respective terminal by means of a screw/nut assembly 23.

The protective cover 20 is able to be attached above the switching module 16 in the first, third and fourth configurations A1, A3, A4 of the switching system, or above the control module 18 according to the second configuration A2 of the switching system.

Each fixed contact 34A, 34B, 38A, 38B comprises a contact pad 52 which cooperates with a pad 54 of the corresponding mobile contact 36, 40. Each fixed contact 34A, 34B, 38A, 38B is preferably in copper or a copper alloy.

Each mobile contact 36, 40 is able to bear against the two fixed contacts 34A and 34B, 38A and 38B of the corresponding electric switch 30, 32 in closed position of the said switch, and to lie away from the two fixed contacts 34A and 34B, 38A and 38B of the same electric switch 30, 32 in open position of the said switch.

Each mobile contact 36, 40 is in the form of a tongue arranged in a plane perpendicular to the longitudinal axis X, comprising a transverse axis Y extending from right to left and the vertical axis Z as shown in FIG. 5. Each mobile contact 36, 40, at each of its ends along the transverse axis Y, comprises a contact pad 54 contacting the mating pad 52 of the corresponding fixed contact.

Each mobile contact 36, 40 has a cross-section of variable surface area in relation to the electric power of the current able to circulate through the electric switch. Each mobile contact 36, 40 is preferably in copper or a copper alloy.

The holder member 45 comprises housings 56 to receive the respective mobile contacts 36, 40. In the example of embodiment in FIGS. 5 to 10, the holder member 45 comprises four receiver housings 56, two housings among the four receiving both a first mobile contact 36 and a second mobile contact 40.

The holder member 45 comprises four mechanical coupling elements 60A, 60B, 62A, 62B with the electric driving device 48, namely a first 60A and a second 60B transverse coupling element, and a first 62A and a second 60B axial coupling element, each coupling element being able to ensure mechanical connection with the driving device 48 in a respective configuration among the first A1, second A2, third A3 and fourth A4 configurations of the control module 18 relative to the switching module 16.

For each configuration A1, A2, A3, A4, the mechanical coupling between the holder member 45 and the driving device 48 is ensured by a single respective mechanical coupling element 60A, 60B, 62A, 62B. Each mechanical coupling element 60A, 60B, 62A, 62B corresponds to a single configuration A1, A2, A3, A4 of the driving device 48 relative to the holder member 45 of the switching module.

The holder member 45 is mobile in translation in a drive direction parallel to the longitudinal axis X and perpendicular to the plane in which contact pads 52, 54 are arranged. The holder member 45 is mobile between a rear position in which the first electric switches 30 are closed, and a front position in which the second electric switches 32 are closed. The holder member 45 is also able to be placed in an intermediate position between the front position and the rear position. In the intermediate position of the holder member 45, the switches 30, 32 are both in open position as illustrated in FIGS. 7 and 9.

The holder member 45, with respect to the mobile contacts 36, 40, the receiver housings 56 and the transverse coupling elements 60A, 60B, has a horizontal plane of symmetry P1, the said plane of symmetry P1 containing the drive direction and being perpendicular to the mobile contact 36, 40. The first transverse coupling element 60A and the second coupling element 60B are symmetrical with each other relative to the said horizontal plane of symmetry.

The holder member 45 is made in an electrically insulating material.

The driving device 48 is capable of driving the holder member 45 in translation in the drive direction, and is therefore capable of simultaneously driving the mobile contacts 36, 40 of the plurality of electric switches 30, 32 so as to ensure simultaneous switching of the first switches 30 and of the second switches 32.

Figure 6:
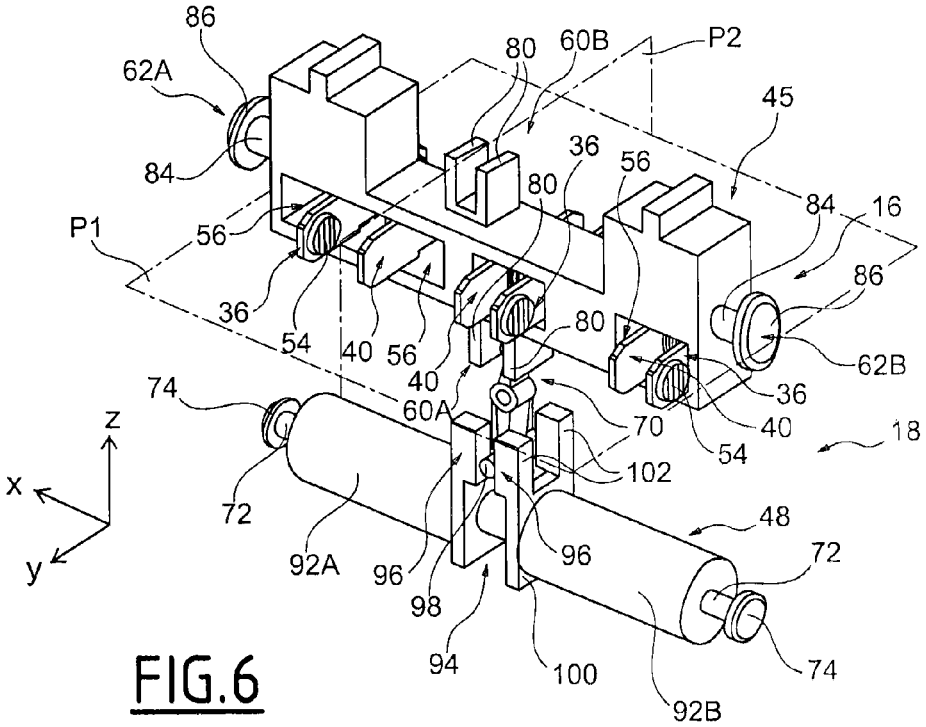
FIG. 6 is a perspective view of a contacts-holder and of a driving device of the contacts-holder of the system in FIG. 1.
Figure 10:
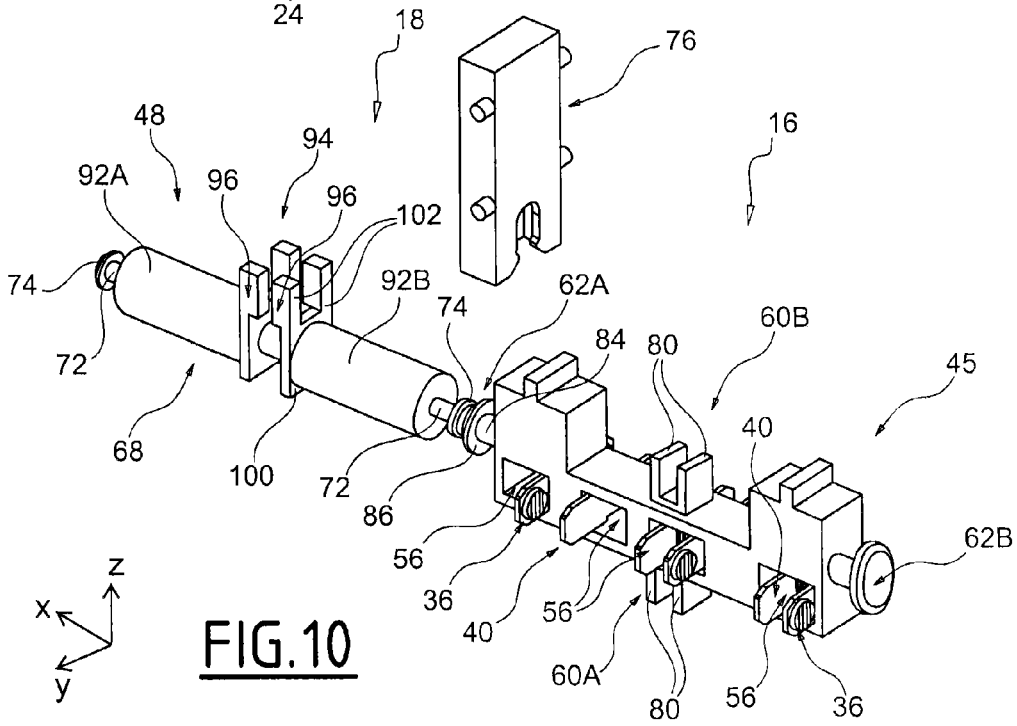
FIG. 10 is a similar view to FIG. 6 in the fourth configuration of the control module relative to the switching module.

The driving device 48 which can be seen in FIGS. 5 and 8 and partly in FIGS. 6 and 10, comprises a first 66A and a second 66B electromagnetic coil successively arranged along the longitudinal axis X, a plunger 68 capable of sliding along the longitudinal axis inside the coils 66A, 66B, each coil 66A, 66B being capable of applying a magnetic force on the plunger 68 to actuate the plunger 68 in alternating translational movement along the longitudinal axis X.

The driving device 48 comprises a driving lever 70 capable of cooperating with the first transverse coupling element 60A, or respectively with the second transverse coupling element 60B, when the switching system 10 is in its first configuration A1, or respectively in its second configuration A2. The driving lever 70 mechanically connected to the plunger 68 is then capable of driving the holder member 45 in translation.

The driving device 48 comprises a shaft 71 around which the driving lever 70 is mobile in rotation, as illustrated in FIGS. 5 and 8.

The driving device 48, at each end of the plunger 68, comprises a rod 72 extending in the drive direction and a coupling head 74 arranged at the end of the rod 72 which is not attached to the plunger 68. The coupling head 74 is able to be mechanically connected via a connecting element 76 to the first axial coupling element 62A or respectively to the second axial coupling element 62B, when the switching system 10 is in the third configuration A3, or respectively in the fourth configuration A4.

The contact pads 52, 54 are electrically conductive, preferably in a silver alloy. The contact pads 52, 54 are each in the form of a flat round and arranged in a plane of axes Y and Z, perpendicular to the drive direction.

Each receiver housing 56 passes through the holder member 45 from side to side along the transverse axis Y. Each receiver housing 56 comprises at least one bearing surface 78 for a corresponding mobile contact 36, 40. Each bearing surface 78 is substantially arranged in the plane of axes Y and Z, perpendicular to the longitudinal axis X. The two housings 56 at the back of the holder member 45 illustrated on the left in FIG. 5, are receiver housings for a first mobile contact 36 and a second mobile contact 40 and comprise two bearing surfaces 78 arranged facing one another.

Each transverse mechanical coupling element 60A, 60B is capable of allowing the coupling of the holder member 45 with the driving device 48 in a direction perpendicular to the drive direction, preferably along the vertical axis Z in the first and second configurations A1, A2.

The first transverse coupling element 60A and the second transverse coupling element 60B are symmetrical with each other relative to the horizontal plane P1 of axes X and Y and containing the drive direction as illustrated in FIG. 6.

Each transverse coupling element 60A, 60B, in the vicinity of the middle of the holder member 45 along the longitudinal axis X, comprises two fingers 80 successively arranged in the drive direction and extending transversely relative to the drive direction, preferably vertically. The two fingers 80 of each transverse coupling element are capable of cooperating with a first end 82 of the driving lever 70 mechanically connected to the driving device. The fingers 80 are made in one same piece with the holder member 45.

Each axial coupling element 62A, 62B is capable of allowing the coupling of the holder member 45 with the driving device 48 in a direction parallel to the drive direction i.e. along the longitudinal axis X in the third and fourth configurations A3, A4.

The first axial coupling element 62A and the second axial coupling element 62B are symmetrical with each other relative to a plane perpendicular to the drive direction, preferably relative to a plane P2 of axes Y and Z and passing substantially through the middle of the holder member 45 along the longitudinal axis X as illustrated in FIG. 6.

Each axial coupling element 62A, 62B is arranged at a respective longitudinal end of the holder member and comprises a rod 84 extending in the drive direction and a coupling head 86 arranged at one end of the rod 84, the coupling head 86 being able to be mechanically connected with a corresponding coupling head 74 via the connecting element 76. The rod 84 and the coupling head 86 are made in one piece with the holder member 45.

The first coil 66A comprises a core 88A and a winding 90A that is coaxial to the longitudinal axis X and held in place by the core 88A, as illustrated in FIG. 5. The second coil 66B is identical to the first coil 66A and comprises the same parts, each time the letter A being replaced by the letter B for the references of these parts.

The plunger 68 which can be seen in FIGS. 5, 6, 8 and 10 comprises a first end part 92A, a second end part 92B and an intermediate part 94 forming the connecting member of the two end parts 92A, 92B. Each coil 66A, 66B is capable of applying a magnetic force essentially in the direction of one of the end parts 92A, 92B.

The plunger 68 comprises two bearing plates 96 against a second end 98 of the driving lever 70, the bearing plates 96 being successively arranged along the longitudinal axis X as illustrated in FIG. 6.

The driving lever 70 is mechanically connected to the plunger 68 and to the holder member 45 only in the first and second configurations A1, A2 to drive the holder member 45 in translation along the longitudinal axis X further to actuation of the plunger 68 in translation along the longitudinal axis X as illustrated in FIG. 5. The driving lever 70 is mobile in rotation about the shaft 71 extending parallel to the transverse axis Y and perpendicular to the longitudinal axis X. The rod 72 and the coupling head 74 are attached to each end part 92A, 92B. The rod 72 and the coupling head 74 are made in one piece with the plunger 68.

The connecting element 76 is a mobile part of the protective cover 20 such as a breakable part.

As a variant, not illustrated, the connecting element between the holder member 45 and the plunger 68 comprises a connecting part mobile between a rest position in which it is integrated in the body of the plunger 68, and an assembly position in which it is partly withdrawn from the plunger 68 to ensure mechanical connection of the plunger 68 with the holder member 45. The connecting part comprises a body and a head capable of cooperating with the holder member 45. The body is threaded for example. The head has a square cross-section to allow the immobilisation in rotation about the longitudinal axis X of the connecting part, through the cooperation between the head of the said connecting part and a mating part of the holder member 45. The connecting part is in metal or plastic depending on magnetic flows. The connecting part is able to be removed from its rest position towards its assembly position, in particular by unscrewing the connecting part if its body is threaded. This variant allows a connection without an element arranged outside the holder member 45 or the plunger 68, the connecting part in rest position being integrated in the body of the plunger 68.

The end parts 92A, 92B of the core are each in the form of a cylinder and in ferromagnetic material. The ends of the end parts 92A, 92B are disc-shaped in the transverse plane of axes Y and Z.

The intermediate part 94 of the plunger comprises a cylindrical rod 99 and the two bearing plates 96 attached to the rod. The intermediate part 94 is positioned substantially in the centre of the plunger along the longitudinal axis X. The intermediate part 94 is arranged substantially in the centre of the corresponding disc-shaped end of each end part 92A, 92B in the transverse plane of axes Y and Z.

Each bearing plate 96 comprises a rectangular part 100 extended by two fingers 102 extending vertically, as illustrated in FIG. 6.

The control module 18 has a plane of symmetry P3 perpendicular to the drive direction, shown in FIG. 5, the said plane P3 being a transverse plane of axes Y and Z passing through the centre of the control module 18 along the longitudinal axis X. The first coil 66A and the second coil 66B are symmetrical with each other relative to the said transverse plane of symmetry P3, and the first end part 92A and second end part 92B of the plunger are also symmetrical with each other relative to the said transverse plane of symmetry P3.

Therefore the electric switching system 10 is particularly modular, since the control module 18 can be positioned relative to the switching module 16 in four different manners according to the four configurations A1, A2, A3, A4 as can be seen in FIGS. 1 to 4. For each configuration, the holder member 45 is mechanically coupled to the driving device 48 via a single coupling element among the first and second coupling elements 60A, 60B and the first and second axial coupling elements 62A, 62B.

According to the first configuration A1, the switching module 16 is arranged above the control module 18, and the holder member 45 is mechanically coupled to the driving device 48 via the first transverse coupling element 60A and the driving lever 70, as illustrated in FIGS. 5 and 6.

According to the second configuration A2, the switching module 16 is arranged underneath the control module 18, and the holder member 45 is mechanically coupled to the driving device 48 via the second transverse coupling element 60B and the driving lever 70 as illustrated in FIG. 8.

The changeover between the two transverse configurations A1, A2 is particularly easy to obtain since it is sufficient to separate the switching module 16 from the control module 18, to cause the control module 18 to pivot by an angle of 180° about the longitudinal axis X so that the driving lever 70 and the plates 96 of the plunger 68 are respectively oriented downwardly as illustrated in FIG. 8 and upwardly (FIG. 9), and finally to secure the control module 18 above, respectively below, the switching module 16.

Through the presence of the first and second transverse coupling elements 60A, 60B symmetrical with each other relative to a horizontal plane of axes X and Y, the changeover from the first configuration A1 to the second configuration A2, and conversely from the second configuration A2 to the first configuration A1, does not necessitate the inverting of the holder member 45.

According to the third configuration A3 illustrated in FIGS. 3 and 10, the switching module 16 is arranged behind the control module 18 and the holder member 45 is mechanically coupled to the driving device 48 via the first axial coupling element 62A as illustrated in FIG. 10. The coupling head 86 of the first axial coupling element is then secured to the coupling head 74 of the plunger by means of the connecting element 76. According to this configuration, the coupling heads are mobile along the longitudinal axis through orifices, not illustrated, arranged in the corresponding walls of the switching module 16 and control module 18.

According to the fourth configuration A4 which can be seen in FIG. 4, the switching module 16 is arranged in front of the control module 18 and the holder member 45 is mechanically coupled to the driving device 48 via the second axial coupling element 62B. Similar to the third configuration A3, the second axial coupling element 62B is then coupled and secured with a corresponding coupling head of the plunger via the connecting element 76.

Through the first second axial coupling elements 62A, 62B, symmetrical with each other relative to a transverse plane of axes Y and Z, the changeover between the two axial configurations does not require the pivoting of the switching module 16 by an angle of 180° about the longitudinal axis X. This makes it possible, when the input terminals 12A, 12B, 12C and output terminals 14A, 14B, 14C are connected to electric cables via screw/nut assemblies, to change over from the third configuration A3 to the fourth configuration A4, or conversely from the fourth configuration A4 to the third configuration A3, without having to disconnect the electric cables.

If the user wishes to change over from a configuration in which the input terminals 12A, 12B, 12C and output terminals 14A, 14B, 14C are able to be connected to electric cables, as illustrated in FIG. 7, to a configuration in which the input and output terminals are intended to be soldered to a printed circuit, as illustrated in FIG. 9, it is sufficient to cause the input terminals 12A, 12B, 12C, the output terminals 14A, 14B, 14C and the associated fixed contacts 34A, 34B, 38A, 38B to pivot by an angle of 180° about the longitudinal axis X.

The changeover from a transverse configuration i.e. a configuration among the first and second configurations A1, A2, to an axial configuration i.e. a configuration among the third and fourth configurations A3, A4 is particularly easy to obtain since it is sufficient to separate the switching module 16 from the control module 18 and to mount the switching module 16 and the control module 18 one beside the other whilst securing the coupling head 86 of the corresponding axial coupling element 62A, 62B with the corresponding coupling head 74 of the plunger by means of the connecting element 76. The driving lever 70 which is not required for the operation of the switching system in axial configuration, can be removed or else left in place to act as indicator of the direction of operation.

In similar manner, the changeover from the axial configuration A3, A4 to a transverse configuration A1, A2, is also simple to implement since it is sufficient to separate the switching module 16 from the control module 18 in particular by removing the connecting element 76 which is not needed for the operation of the switching system in the transverse configurations A1, A2, and to mount the switching module 16 and the control module 18 one above the other, whilst mechanically connecting the corresponding transverse coupling element 60A, 60B to the plunger 68 by means of the driving lever 70.

The fact that the input and output terminals each comprise both a mounting plate 22 and a connector pin 24 makes it possible to change over easily from the configuration in which the terminals are connected to electric cables to the configuration in which the terminals are connected to a printed circuit, without having to modify the input and output terminals.

The operation of the electric switching system 10 according to the invention will now be described.

In the absence of any command from the electromagnetic coils 66A, 66B, the driving device 48 is in rest position and the intermediate part 94 of the plunger is arranged substantially mid-way between the coils 66A, 66B along the longitudinal axis X. The holder member 45 is then in its intermediate position through the mechanical coupling between the holder member and the driving device, and all the electric switches 30, 32 are in open position. No electric current then circulates between the input terminals 12A, 12B, 12C and the output terminals 14A, 14B, 14C.

When a coil among the first and second coils 66A, 66B is actuated by control means, not illustrated, the said coil sets up a field which attracts the corresponding end parts 92A, 92B of the plunger, and the driving device 48 then changes from its rest position to a position among its first and second working positions. The actuation of the said coil then causes the displacement of the holder member 45 from its intermediate position towards a position among its front and rear position, the said position being a function of the configuration of the control module 18 relative to the switching module 16 among the first, second, third and fourth configurations A1, A2, A3, A4. The translation of the holder member 45 then causes the closing of the second electric switches 32, the first electric switches 30 remaining in open position, if the said position is the front position of the holder member 45, or else the closing of the first electric switches 30 in which case the second electric switches 32 remain in open position if the said position is the rear position of the holder member 45.

In the first configuration A1, as illustrated in FIG. 5, when the first coil 66A sets up a field which attracts the first end part 92A of the plunger towards the rear, the driving device 48 changes from its rest position to its first working position with movement in the direction of the arrow F1. The second end 98 of the driving lever 70 is moved towards the rear through the mechanical connection between the intermediate part 94 and the second end 98, and the first end 82 of the lever is then moved towards the front, the driving lever 70 performing a rotational movement of axis Y about the shaft 71 in the direction of the arrow F2. The actuation of the first coil 66A therefore causes the movement in the direction of arrow F3 of the holder member 45 from its intermediate position towards its front position, in which the second electric switches 32 are in closed position whilst the first electric switches 30 are in open position.

When the other coil among the first and second coils 66A, 66B is actuated, it sets up a field which attracts the other end part of the plunger which induces translation of the plunger along the longitudinal axis. The driving device 48 subsequently changes from one working position to the other. The actuation of the other coil then causes the movement of the holder member 45 which causes the opening of the electric switches 30, 32 which were previously closed and the closing of the other electric switches which were previously open.

In the first configuration A1, as illustrated in FIG. 5, when the second coil 66B sets up a field which attracts the second end part 92B of the plunger towards the front, this induces displacement of the plunger 68 in the direction of arrow F4. The driving device 48 then changes from its first working position to its second working position. The second end 98 of the driving lever 70 is moved towards the front via the mechanical connection between the intermediate part 94 and the second end 98, and the first end 82 of the lever is then moved towards the back, the driving lever 70 performing a rotational movement of axis Y about the shaft 71 as shown by arrow F5. The actuation of the second coil 66B then causes the movement of the holder member 45 from its front position or from its intermediate position if the second coil 66B is actuated whereas the driving device 48 is at rest, towards its rear position in the direction arrow F6. In the rear position of the holder member 45, the first electric switches 30 are in closed position whilst the second electric switches 32 are in open position.

The movements of the driving device 48 and of the holder member 45 in the second configuration A2 are similar to those described previously in the case of the first configuration A1.

The movements of the driving device 48 and of the holder member 45 in the third and fourth configurations A3, A4 are translational movements along the longitudinal axis X, the movement of the driving device 48 in one direction generating movement of the holder member 45 in the same direction.

Since the plunger 68 is made in a single rigid piece, the first switches 30 and the second switches 32 cannot be closed simultaneously, thereby preventing the risk of a short circuit. It is therefore not necessary to provide for an additional protection system against short circuits of mechanical locking type.

It can therefore be appreciated that the electric switching module 16 of the invention allows several possible configurations A1, A2, A3, A4 to be proposed for the switching module relative to its control module 18, whilst minimising the handling operations needed to change from one configuration to another. The switching system 10 of the invention is therefore particularly modular.

The switching system 10 of the invention also allows easy changeover from the configuration in which the input and output terminals are connected to electric cables, to the configuration in which the input and output terminals are connected to a circuit board.

Figure 11:
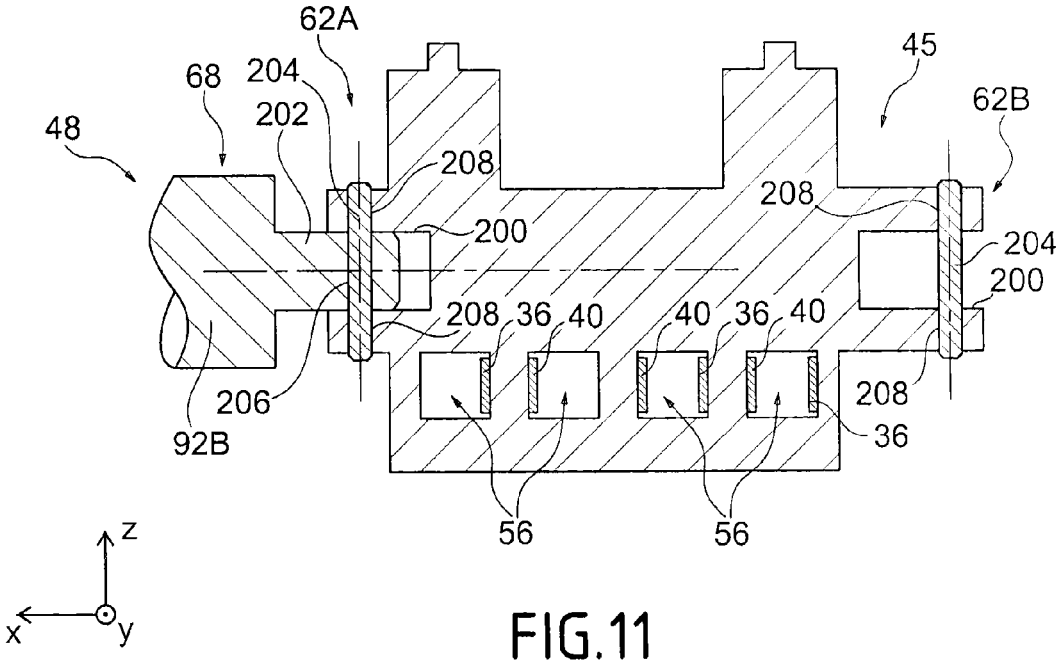
FIG. 11 is a schematic view similar to FIG. 10 according to a second embodiment.

FIG. 11 illustrates a second embodiment of the invention in which the elements similar to the first previously described embodiment carry the same reference numbers. The second embodiment illustrates a variant of the axial coupling between the holder member 45 and the driving device 48. The other elements of the first embodiment and their variants can be associated therewith.

According to the second embodiment, each first and second axial coupling element 62A, 62B comprises an orifice 200 for receiving a rod 202 secured to the driving device 48 and a pin 204 holding the rod 202 in the receiving orifice 200.

The receiving orifice 200 extends in the drive direction i.e. along the longitudinal axis X.

The rod 202 is made in one piece with the corresponding end part 92A, 92B of the plunger 68. The rod 202 comprises a through hole 206 able to receive the retaining pin 204 when the axial coupling element 62A, 62B and the plunger 68 of the driving device are mechanically coupled.

The retaining pin 204 is intended to be inserted in through holes 208 arranged in the holder member 45 and mating with the through hole 206 when the rod 202 is inserted in the receiving orifice 200.

The through holes 206, 208 extend in a direction perpendicular to the longitudinal axis X, preferably along the vertical axis Z.

The axial mechanical coupling according to the second embodiment provides for greater mechanical rigidity of the assembly formed by the holder member 45 and the driving device 48.

The operation of this second embodiment is otherwise identical to that of the first embodiment described previously. The other advantages of this second embodiment are identical to those of the first previously described embodiment.

Figure 12:
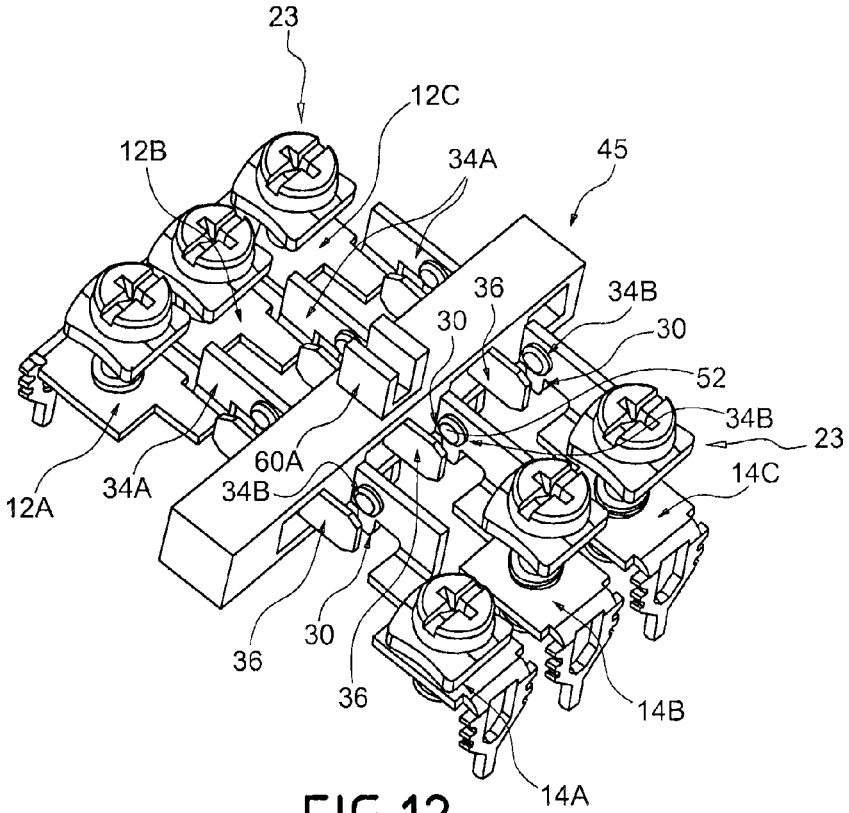
FIG. 12 is a similar view to FIG. 9 according to a third embodiment.

FIG. 12 illustrates a third embodiment of the invention in which elements similar to the first previously described embodiment carry the same reference numbers.

According to the third embodiment, the switching system 10 is a three-phase contactor capable of opening or closing each electric connection between an input terminal 12A, 12B, 12C and a corresponding output terminal 14A, 14B, 14C associated with a respective phase of a three-phase current.

The switching module 16 then only comprises the three first electric switches 30 and no second electric switches, and each input terminal 12A, 12B, 12C is electrically connected only to a first fixed input contact 34A, each output terminal 14A, 14B, 14C being electrically connected to the corresponding first fixed output contact 34B.

The first 12A, second 12B and third 12C input terminals are then respectively connected to the first 14A, second 14B and third 14C output terminals in closed position of the first switches 30, and the output terminals are electrically insulated from the input terminals in open position of the first switches 30.

The operation of this third embodiment is otherwise identical, with regard to the driving of the holder member 45 via the electric driving device 48, to the first embodiment described previously.

The other advantages of this third embodiment are identical to those of the first previously described embodiment.

FIGS. 13 to 18 illustrate a fourth embodiment of the invention in which elements similar to the first embodiment previously described carry the same reference numbers.

Figure 13:
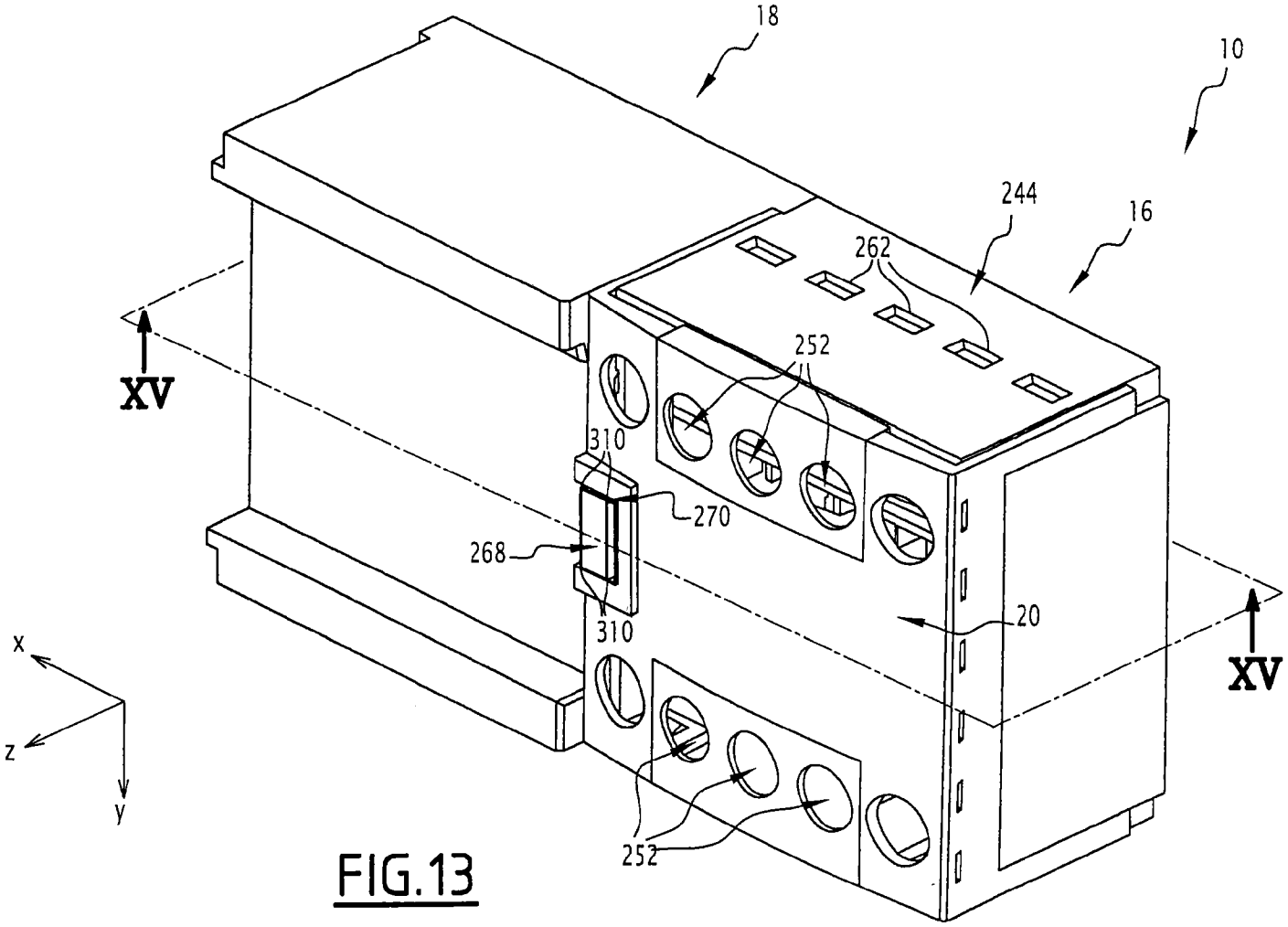
FIG. 13 is a schematic, perspective illustration of the electric switching system according to a fourth embodiment, comprising the switching module including the contacts-holder, the control module including the contacts-holder driving device, and a connecting element connecting the mechanical coupling elements of the contacts-holder and the driving device, the connecting member being in a first separation position.
Figure 14:
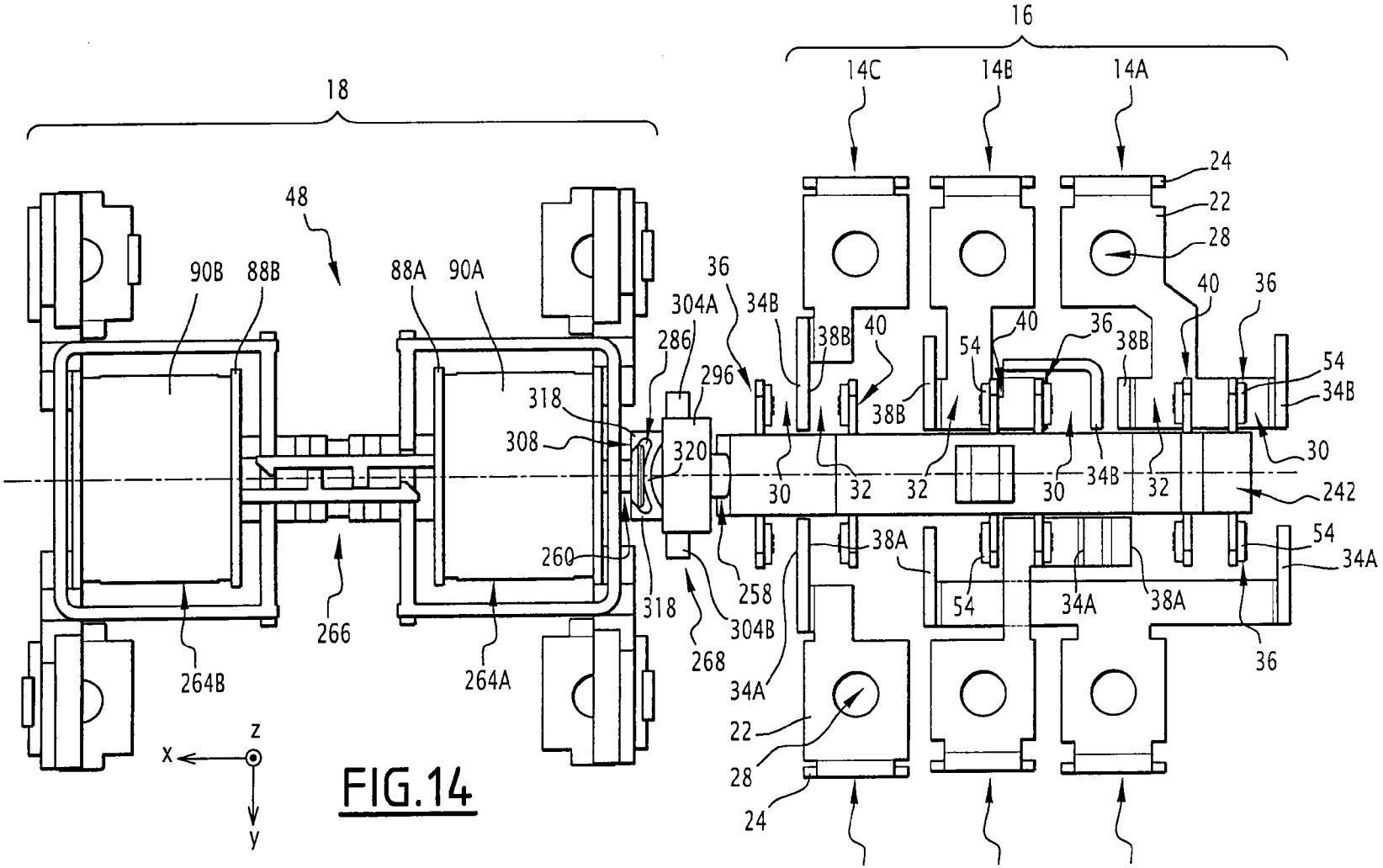
FIG. 14 is a partial overhead view of the switching system in FIG. 13, the connecting element being in a second associated position in which the coupling elements are mechanically connected by the connecting element.

In the example of embodiment shown in FIG. 13, the switching module 16 and the control module 18 are arranged side by side along the longitudinal axis X extending from back to front. In the primary axial configuration, the switching module 16 lies behind the control module 18 as illustrated in FIG. 13, similar to FIG. 3.

The switching module 16 comprises a holder device 242 for the first three mobile contacts 36 and second three mobile contacts 40. This device 242 also called a contacts-holder is itself mobile between a first position in which the first switches 30 are closed and the second switches 32 are open, and a second position in which the first switches 30 are open and the second switches 32 are closed. The holder device 242 is identical to the holder member 45, also called a contacts-holder, described in the three first embodiments.

Figure 16:
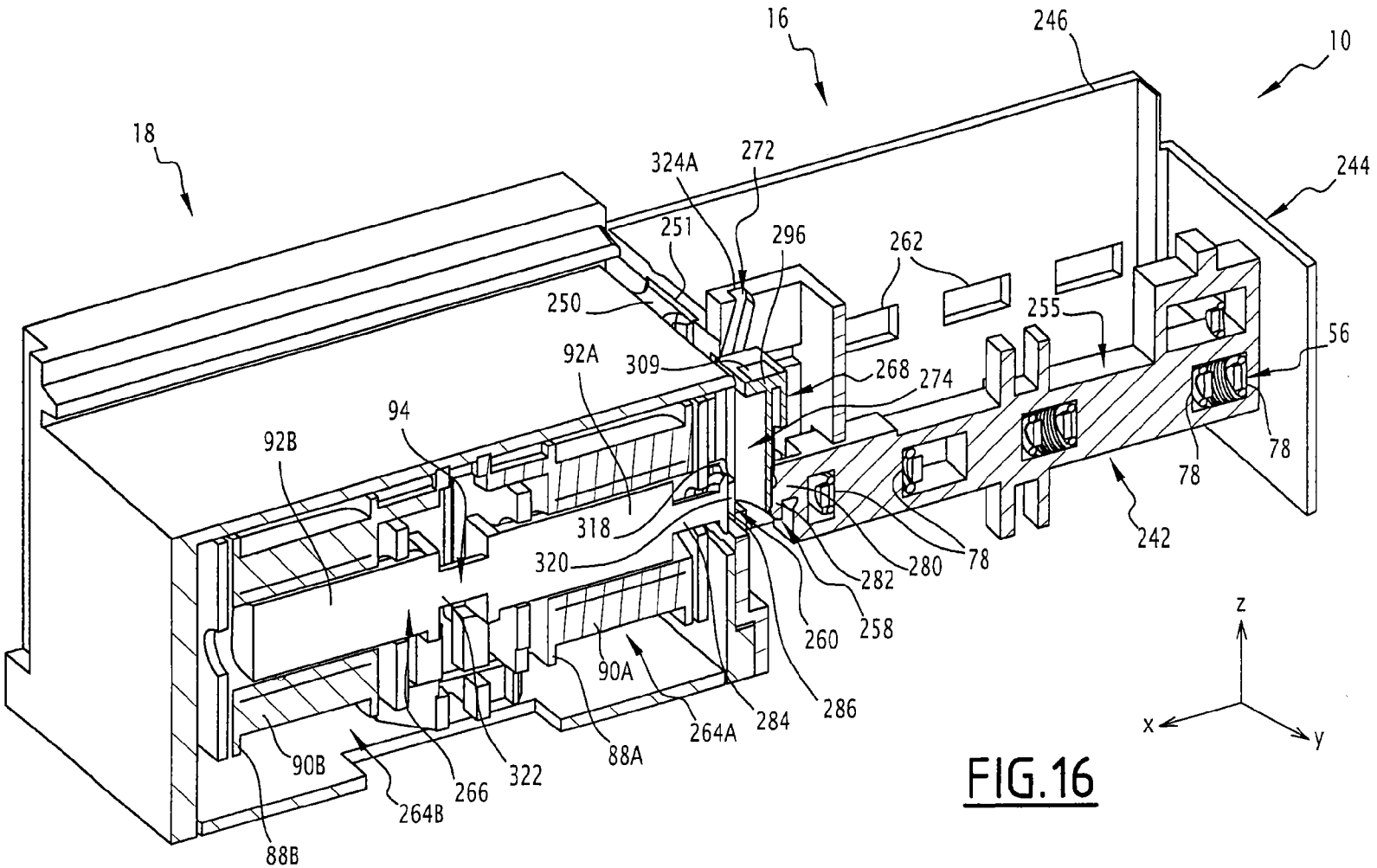
FIG. 16 is a similar view to FIG. 15, the connecting element being in its second position.

The switching module 16 comprises a protective casing 244 to protect the input and output terminals 12A, 12B, 12C, 14A, 14B, 14C, the first and second switches 30, 32 and the holder device 242. This protective casing 244 has an upper opening 246 giving access to the input and output terminals, to the first and second switches and to the holder device, as illustrated in FIG. 16.

The driving device 48 is capable of driving the holder device 242 between its first and second positions, so as to ensure simultaneous switching of all the electric switches 30, 32.

The control module 18 and the switching module 16 are assembled via a dovetail device. The control module 18 comprises two studs 250, each of trapezoid shape, and the switching module 16 comprises two grooves 251 each of shape mating with the shape of the corresponding stud 250. Each stud 250 is able to slide along the vertical axis Z in a corresponding groove 251.

The protective cover 20 which can be seen in FIGS. 13 to 17 comprises circular openings 252 giving access to the input terminals 12A, 12B, 12C and to the output terminals 14A, 14B, 14C. These access openings 252 allow users to secure the clamp of an electric cable to be connected to a respective terminal by means of the screw/nut assembly of this terminal.

The protective cover 20 is made in an electrically insulating material. The protective cover 20 is able to be fixed above the switching module 16 so as to shut off the upper opening 46 during the operation of the switching system and thereby avoid any risk of electrocution.

Each fixed contact 34A, 34B, 38A, 38B and each mobile contact 36, 40 is preferably in copper. Each mobile contact 36, 40, at each of it ends along the transverse axis Y, comprises the contact pad 54 contacting the corresponding fixed contact.

The holder device 242 comprises a main body 255 extending substantially longitudinally and the receiver housings 56 for the respective mobile contacts 36, 40, the receiver housings being arranged transversely in the main body 255. In the example of embodiment shown FIGS. 15 and 16, the holder device 242 comprises four receiver housings 56, two housings among the four receiving both a first mobile contact 36 and a second mobile contact 40. The holder device 242 is made in an electrically insulating material.

In similar manner to the holder member 45, the holder device 242 is mobile in translation in the drive direction parallel to the longitudinal axis X and perpendicular to the plane in which the contact pads 54 are arranged, between the rear position and the front position, it also being possible for the holder device 242 to be arranged in the intermediate position.

The holder device 242 comprises a first mechanical coupling element 258 to a mating second coupling element 260 of the electric driving device 48, in a direction parallel to the drive direction i.e. along the longitudinal axis X.

The protective casing 244 comprises lateral rectangular openings 262 for passing electric cables intended to be attached to the input and output terminals 12A, 12B, 12C, 14A, 14B, 14C. The protective casing 244 is in the shape of a rectangular parallelepiped.

Figure 15:
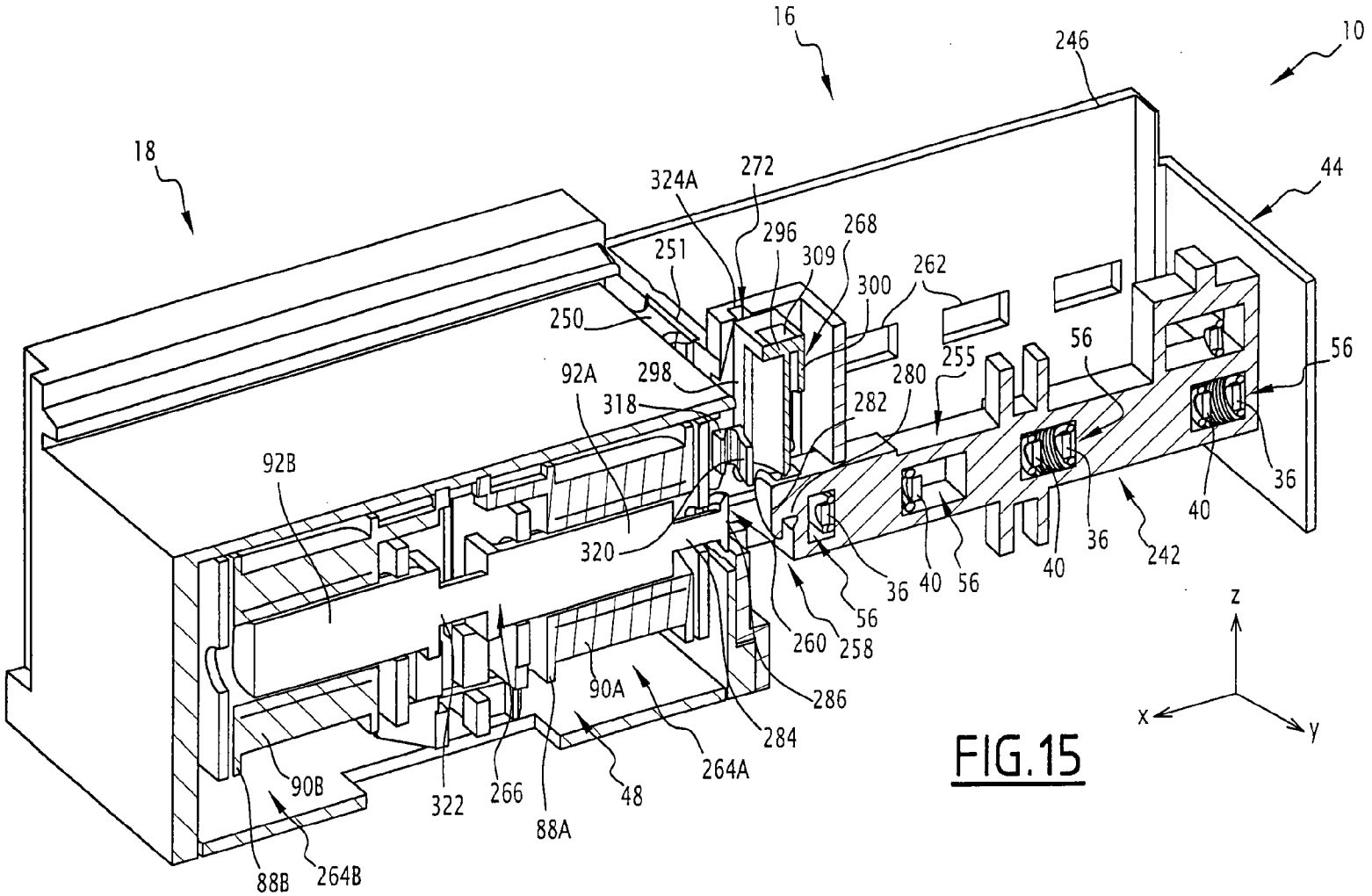
FIG. 15 is a cross-section along plane XV in FIG. 13, the connecting element being in its first position; fixed contacts and input and output terminals are not shown for clarity of the drawing.

The driving device 48 which can be seen in FIGS. 15 and 16 comprises a first 264A and a second 264B electromagnetic coil successively arranged along the longitudinal axis X, a plunger 266 able to slide along the longitudinal axis inside the coils 264A, 264B, each coil 264A, 264B being capable of applying a magnetic force on the plunger 266 to actuate the plunger 266 in alternate translational movement along the longitudinal axis X. The driving device 48, at one longitudinal end of the plunger 266, comprises the second coupling element 260.

The switching system 10 comprises a connecting element 268 connecting the two coupling elements 258, 260, the connecting element 268 being part of the protective cover 20, mobile between a first separation position in which the two coupling elements are mechanically separated from one another (FIG. 15) and a second associated position in which the two coupling elements are mechanically connected by the connecting element 268 (FIG. 16).

The switching system 10 comprises means 270 for attaching the connecting element 268 in its first position as illustrated in FIG. 13. The switching system 10 comprises means 272 for guiding the connecting element between its first and second positions and locking means 274 to lock the connecting element in its second position as illustrated in FIG. 16.

The first position of the connecting element, also called the top position, is a position in which the connecting element 268 lies away from the two coupling elements 258, 260. The coupling elements 258, 260 are then mechanically free from each other as illustrated in FIG. 15.

The second position of the connecting element, also called the bottom position, is a position in which the connecting element 268 is mechanically connected to the first coupling element 258 and to the second coupling element 260, so that the coupling elements 258, 260 are mechanically connected via the connecting element 268 as illustrated in FIG. 16.

The first coupling element 258 comprises a first rod 280 extending in the drive direction and a first coupling head 282 arranged at the end of the first rod 280 which is not attached to the main body 255. The first coupling element 258 is made in one piece with the main body 255.

The second coupling element 260 comprises a second rod 284 extending in the drive direction and a second coupling head 286 arranged at the end of the second rod 284 which is not attached to the plunger 266. The second coupling element 260 is made in one piece with the plunger 266.

The first coupling element 258 and the second coupling element 260 are similar to the first and second axial coupling elements 62A, 62B described in the preceding embodiments.

The first coil 264A, the second coil 264B and the plunger 266 are respectively identical to the first coil 66A, the second coil 66B and the plunger 68 described in the preceding embodiments.

Figure 17:
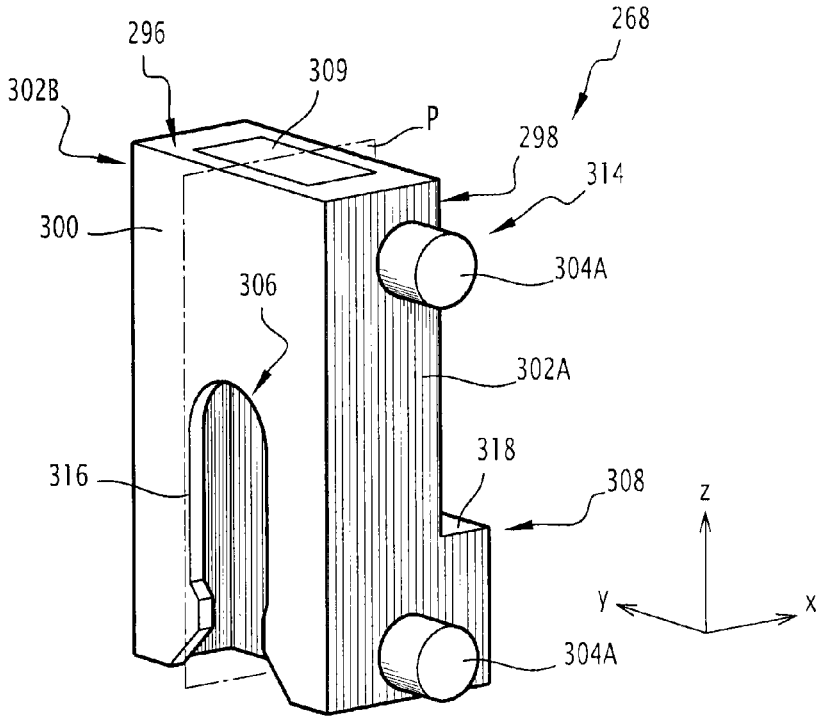
FIG. 17 is a magnified, perspective schematic view of the connecting element.

The connecting element 268 is substantially in the shape of a rectangular parallelepiped and comprises an upper wall 296 and four side walls, namely a front wall 98, a back wall 100, a right wall 102A and a left wall 102B as illustrated in FIG. 17. The connecting element 268 has a median plane of symmetry P parallel to the axes X and Z.

The connecting element 268 comprises to first lugs 304A and two second lugs 304B, the two first lugs 304A, respectively the two second lugs 304B being spaced away from each other along the axis Z and respectively fixed to the right wall 302A, and the left wall 302B. The four lugs 304A, 304B are preferably made in one piece with the corresponding wall 302A, 302B. The four lugs 304A, 304B are in the shape of a cylinder having a generating line parallel to the transverse axis Y.

The connecting element 268 comprises first hooking means 306 for the first head 282 and second hooking means 308 for the second head 286.

The connecting element 268 comprises an indicator 309 indicating the position among the open and closed positions of the switch 30, 32. This indicator 309 can be seen from outside the system 10. The indicator 309 is glued to the upper wall 296 of the connecting element. As a variant, the indicator 309 is etched in the upper wall 296 of the connecting element.

The attaching means 270 comprise breakable strips 310 extending along the transverse axis Y and connecting the connecting element 268 in its first position to the remainder of the protective cover 20, as illustrated in FIG. 13.

The guiding means 272 comprise a cam surface 312 secured to the protective cover 20 and capable of cooperating with a counter-cam 314 of the connecting element 268, so as to achieve guiding of the connecting element 268 simultaneously in the drive direction and in a direction perpendicular to the drive direction, namely along the longitudinal X and vertical Z axes.

The locking means 274 comprise the first hooking means 306 which include an opening 316 arranged in the back wall 300 of the connecting element and intended to receive the first rod 280, whereas the first head 282 is received inside the connecting element 268. The opening 316 forms press-fit means with the first rod 280. It is of Q shape for example.

The locking means 274 comprise the second hooking means 308 which include two side hooks 318 intended to surround the second head 286, and a flexible median part 320 for bearing of the second head 286 against the side hooks 318.

The first and second coupling heads 282, 286 are of circular shape in a transverse plane of axes Y and Z and have a trapeze-shaped cross-section in the sectional plane of FIG. 15 parallel to axes X and Z.

The intermediate part 94 of the plunger comprises a cylindrical rod 322 arranged substantially in the centre of the disc-shaped corresponding end of each end part 92A, 92B in the transverse plane of axes Y and Z. The intermediate part 94 is positioned substantially in the middle of the plunger along the longitudinal axis X.

The cam surface 312 comprises two first oblique grooves 324A and two second oblique grooves 324B arranged in the protective cover 20. The counter-cam is formed of four lugs 304A, 304B each first lug 304A and respectively each second lug 304B capable of sliding in a corresponding first oblique groove 324A and corresponding second oblique groove 324B respectively. The oblique grooves 324A, 324B each extend in a plane parallel to the axes X and Z obliquely relative to the drive direction, i.e. obliquely relative to the longitudinal axis X. The oblique grooves 324A, 324B, relative to the surface into which they open, are arranged along the transverse axis Y to receive the lugs 304A, 304B.

Figure 18:
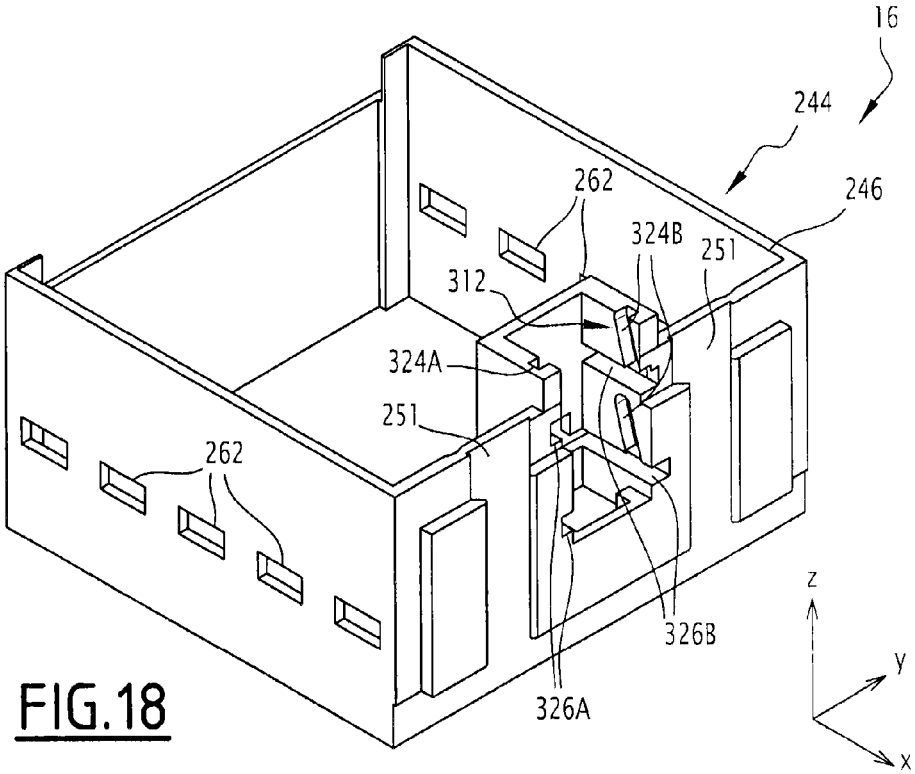
FIG. 18 is a schematic perspective illustration of a casing of the switching module in FIG. 13.

The protective cover 20 comprises two first longitudinal grooves 326A and two second longitudinal grooves 326B arranged along the longitudinal axis X as can be seen FIG. 18. Each first lug 304A, respectively each second lug 304B, is able to slide in a corresponding first longitudinal groove 326A and respectively a second corresponding longitudinal groove 326B.

Initially, the switching 16 and control 18 modules are separated from each other, and the user starts by assembling the switching module 16 with the control module 18 by sliding—from top downwards i.e. along the axis Z—the studs 250 of the control module in the corresponding grooves 251 of the switching module until the configuration in FIG. 13 is obtained. The connecting element 268 is in its first position i.e. in its top position, and the driving device 48 is mechanically separated from the holder device 242.

To allow the switching of the first and second switches 30, 32 via the back-and-forth movement of the holder device 242 in the drive direction, it is necessary mechanically to connect the holder device 242 with the driving device 48. The user then presses from top downwards on the upper wall 296 of the connecting element 268 to cause the connecting element 268 to move from its first position to its second position i.e. from its top position (FIG. 15) to its bottom position (FIG. 16) in which the two coupling elements 258, 260 are mechanically connected via the connecting element 268. The driving device 48 is mechanically connected to the holder device 242 via the coupling elements 258, 260 and the connecting element 268.

The guiding of the connecting element 268 is ensured by the guiding means 272 to allow correct positioning of the connecting element 268 relative to the coupling elements 258, 260.

The locking means 274 allow the mechanical locking of the holder device 242 on the driving device 48 to ensure proper operation of the switching system. The locking means 274 also provide the user with an indication that the connecting element 268 has reached the second position via the press-fit means 316.

The longitudinal grooves 326A, 326B allow back-and-forth movement of the connecting element 268 in the drive direction when the holder device 242 is driven by the driving device 48, the connecting element 268 then being in its second position.

The electric switching system 10 according to the invention therefore allows the easy associating of the switching module 16 with the control module 18 since it is sufficient to slide the studs 250 from top downwards in the grooves 251 and then to press from top downwards on the connecting element 268.

Conversely, the electric switching system 10 of the invention allows the easy separation of the switching module 16 from the control module 18 since it is sufficient to move the connecting element 268 from bottom upwards applying a pulling force from bottom upwards on the upper wall 296, then to separate the switching module 16 from the control module 18 causing the studs 250 to move out of the grooves 251 via sliding of the studs 250 from bottom upwards.

It can therefore be appreciated that the electric switching system 10 of the invention allows the easy association of the switching module 16 with the control module 18, or conversely the separation of the switching module 16 from the control module 18 whilst minimising the handling operations required for such joining and separating.

The operation of the electric switching system 10 according to the fourth embodiment is similar to that of the first embodiment and will not be further described.

Although the switching module 16 and the control module 18 of the invention have been described in connection with a reversing switch allowing the swapping of two phases, evidently the control module of the invention can be used together with a switching module between two possible conductive pathways. In particular, the switching system 10 will then comprise, for each input terminal, a first and a second output terminal, the first output terminal being connected to a corresponding first fixed output contact 34B without any electric connection with the second fixed output contact(s) 38B, and the second output terminal being connected to a corresponding second fixed output contact 38B without any electric connection with the first fixed output contact(s) 34B. The input terminal is electrically connected to the corresponding first fixed input contact 34A and second fixed input contact 38A so that in closed position of the first switch 30 i.e. in first working position of the driving device 48, the current circulates along a first conductive pathway between the said input terminal and the first output terminal, and that in closed position of the second switch 32 i.e. in second working position of the driving device 48, the current circulates along a second pathway between the said input terminal and the second output terminal.

Although the connecting element 268 of the invention has been described as part of the protective cover 20 fixed above the switching module 16, evidently as a variant the connecting element of the invention is part of a protective cover fixed above the control module 18.

The invention claimed is:

1. An electric switching system comprising:

a first, a second, and a third input terminal;

a first, a second, and a third output terminal;

an electric switching module including two first switches and two second switches, each first switch and each second switch being capable of switching between an open position and a closed position and having a fixed input contact, a fixed output contact, and a mobile contact, the fixed input contact, the fixed output contact, and the mobile contact being electrically conductive, the fixed input contact and the fixed output contact being configured to be electrically connected via the mobile contact in a closed position of each first switch and each second switch and the fixed input contact and the fixed output contact being electrically insulated from each other in an open position of each first switch and each second switch, a holder member that holds the mobile contacts of the two first switches and the two second switches, the holder member being configured to be moved by an electric driving device between a first position corresponding to a position among the open and closed positions of the two first switches and the two second switches and a second position corresponding to the other of the positions among the open and closed positions of the two first switches and the two second switches so as to ensure simultaneous switching of the two first switches and the two second switches, the holder member having a first mechanical coupling element configured to couple the holder member with the electric driving device in a primary configuration of the driving device relative to the switching module, and a control module for controlling the switching module;

the first input terminal being electrically connected to the fixed input contact of one of the first switches and to the fixed input contact of one of the second switches, and the second input terminal being electrically connected to the fixed input contact of the other of the first switches and to the fixed input contact of the other of the second switches, the first output terminal being electrically connected to the fixed output contact of one of the first switches and to the fixed output contact of one of the second switches, and the second output terminal being electrically connected to the fixed output contact of the other of the first switches and to the fixed output contact of the other of the second switches, so that in the closed position of both first switches the first input terminal is electrically connected to the first output terminal and the second input terminal is electrically connected to the second output terminal, and in the closed position of both second switches the first input terminal is electrically connected to the second output terminal and the second input terminal is electrically connected to the first output terminal, the third output terminal being electrically connected to the third input terminal, wherein the holder member includes a second mechanical coupling element configured to couple the holder member with the electric driving device in a secondary configuration of the driving device relative to the switching module, wherein the control module includes the electric driving device, and wherein the holder member is mechanically coupled to the electric driving device via the first coupling element in the primary configuration of the control module relative to the switching module, or else via the second coupling element in the secondary configuration of the control module relative to the switching module.

2. The system according to claim 1, wherein the holder member is configured to be moved in translation in a drive direction by the driving device.

3. The system according to claim 2, wherein the first mechanical coupling element and the second mechanical coupling element are transverse mechanical coupling elements symmetrical with each other relative to a plane containing the drive direction.

4. The system according to claim 2, wherein the first mechanical coupling element and the second mechanical coupling element are axial mechanical coupling elements symmetrical with each other relative to a plane perpendicular to the drive direction.

5. The system according to claim 2, wherein the holder member comprises a transverse mechanical coupling element with the driving device configured to couple the driving device with the holder member in a direction perpendicular to the drive direction, and an axial mechanical coupling element with the driving device configured to couple the driving device with the holder member in a direction parallel to the drive direction.

6. The system according to claim 5, wherein the holder member comprises a first and a second transverse coupling element symmetrical with each other relative to a plane containing the drive direction, and a first and a second axial coupling element symmetrical with each other relative to a plane perpendicular to the drive direction.

7. The system according to claim 4, wherein the axial mechanical coupling element comprises a rod extending in the drive direction and a coupling head arranged at one end of the rod, the coupling head being able to be mechanically connected, via a connecting element with another head secured to the driving device.

8. The system according to claim 4, wherein at least one module among the switching module and the control module comprises a protective cover, and the connecting element is part of the protective cover, mobile between a first separation position in which the two coupling elements are mechanically separated from each other and a second associated position in which the two coupling elements are mechanically connected by the connecting element.

9. The system according to claim 8, wherein the system comprises locking means to lock the connecting element in its second position.

10. The system according to claim 8, wherein the system comprises means for guiding the connecting element between its first and second positions.

11. The system according to claim 8, wherein the protective cover comprises means for attaching the connecting element in its first position, the said attaching means preferably being breakable.

12. The system according to claim 4, wherein the axial mechanical coupling element comprises an orifice for receiving a rod secured to the driving device and a pin for retaining the rod in the receiving orifice, the receiving orifice extending in the drive direction.

13. The system according to claim 3, wherein the transverse mechanical coupling element comprises two fingers extending transversely and capable of cooperating with one end of a driving lever mechanically connected to the driving device.

14. The system according to claim 1, wherein each terminal comprises a mounting plate for connecting an electric cable by means of a screw/nut assembly and a connector pin for connection to a printed circuit, the connector pin being configured to be soldered to the printed circuit.

15. The system according to claim 1, wherein the system comprises three first switches and three second switches, each input terminal being electrically connected to the fixed input contact of a respective single switch of the first switches and to the fixed input contact of a respective single switch of the second switches, and each output terminal being electrically connected to the fixed output contact of a respective single switch of the first switches and to the fixed output contact of a respective single switch of the second switches, and the holder member holds the mobile contacts of the three first switches and the three second switches, the holder member being configured to be moved by the electric driving device between a first position corresponding to a position among the open and closed positions of the three first switches and the three second switches and a second position corresponding to the other of the positions among the open and closed positions of the three first switches and the three second switches so as to ensure simultaneous switching of the three first switches and the three second switches, so as to connect the first input terminal with the first output terminal, the second input terminal with the second output terminal and the third input terminal with the third output terminal in the closed position of the first switches, and to connect the first input terminal with the second output terminal, the second input terminal with the first output terminal, and the third input terminal with the third output terminal in the closed position of the second switches.

16. The system according to claim 14, wherein the connector pin and the mounting plate comprise one piece.

* * * * *